US011903441B2

(12) United States Patent
Davis et al.

(10) Patent No.: US 11,903,441 B2
(45) Date of Patent: Feb. 20, 2024

(54) ARTICLES OF FOOTWEAR WITH ADJUSTABLE DIMENSIONS

(71) Applicant: NIKE, Inc., Beaverton, OR (US)

(72) Inventors: Ami M. Davis, Hillsboro, OR (US); Daniel J. Gearhardt, Hillsboro, OR (US); Michelle Haines, Portland, OR (US); George S. Kim, Wilsonville, OR (US); Ryan J. Maddox, Portland, OR (US); Austin J. Orand, Portland, OR (US); Richard S. Ramsay, Portland, OR (US); Sarah E. Sowers, Beaverton, OR (US); Peter P. Williams, II, Portland, OR (US); Patrick D. Boyd, Aloha, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/142,876

(22) Filed: Jan. 6, 2021

(65) Prior Publication Data

US 2021/0204646 A1 Jul. 8, 2021

Related U.S. Application Data

(60) Provisional application No. 62/958,241, filed on Jan. 7, 2020.

(51) Int. Cl.
*A43B 3/24* (2006.01)
*A43B 3/26* (2006.01)
(Continued)

(52) U.S. Cl.
CPC ..... *A43B 13/141* (2013.01); *A43B 3/246* (2013.01); *A43B 3/26* (2013.01); *A43B 5/0488* (2013.01)

(58) Field of Classification Search
CPC ..... A43B 3/244; A43B 3/246; A43B 3/248; A43B 3/26; A43B 7/1495
(Continued)

(56) References Cited

U.S. PATENT DOCUMENTS 641,642 A 1/1900 Gunn
1,603,144 A 10/1926 Nichols
(Continued)

FOREIGN PATENT DOCUMENTS

KR 2011 0065083 A 6/2011
KR 101075789 B1 10/2011
KR 20120003290 U 5/2012

OTHER PUBLICATIONS

International Search Report and Written Opinion mailed in International Application No. PCT/US2021/012357, dated May 31, 2021, 18 pages.
(Continued)

*Primary Examiner* — Sharon M Prange
(74) *Attorney, Agent, or Firm* — Klarquist Sparkman, LLP

(57) ABSTRACT

This disclosure is directed to articles of footwear with adjustable dimensions. More specifically, the articles of footwear disclosed herein include sole structures with adjustable dimensions. In some instances, an article of footwear includes one or more removable insert members configured for adjusting the dimensions of a foot-receiving cavity of the article of footwear. Additionally or alternatively, a sole structure can include one or more flexible portions that can move between compressed and expanded states to accommodate feet of various dimensions. To accommodate the adjustable dimensions of the sole structures, an upper of the article of footwear can be stretchable.

18 Claims, 12 Drawing Sheets

(51) Int. Cl.
*A43B 13/14* (2006.01)
*A43B 5/04* (2006.01)

(58) Field of Classification Search
USPC ..... 36/97
See application file for complete search history.

(56) References Cited

U.S. PATENT DOCUMENTS 1,798,471 A 3/1931 Janke
2,494,770 A 1/1950 MacLaughlin
3,058,241 A * 10/1962 Rigsby ..... A43B 3/30 36/97
3,142,911 A * 8/1964 Raborg ..... A43B 3/30 D2/900
5,729,912 A 3/1998 Gutkowski et al.
5,765,296 A 6/1998 Ludemann et al.
8,959,802 B2 2/2015 Hatfield et al.
10,390,585 B2 * 8/2019 Lee ..... A43C 11/14
2005/0115112 A1 6/2005 Bonfanti
2007/0043582 A1 2/2007 Peveto et al.
2008/0083138 A1 4/2008 Lacorazza et al.
2008/0168683 A1 7/2008 Keating
2009/0025256 A1 1/2009 Bizzo
2009/0090027 A1 * 4/2009 Baudouin ..... A43B 7/1495 602/23
2012/0011744 A1 * 1/2012 Bell ..... A43B 19/00 36/91
2012/0198720 A1 * 8/2012 Farris ..... A43B 13/42 36/12
2012/0198721 A1 * 8/2012 Cavaliere ..... A43B 23/16 36/42
2013/0125420 A1 5/2013 Raghuprasad
2014/0190039 A1 7/2014 Murtha et al.
2015/0089839 A1 * 4/2015 James ..... A43C 11/006 36/102
2015/0289595 A1 10/2015 Rushbrook et al.
2015/0305432 A1 10/2015 Wiens
2016/0331082 A1 11/2016 Weidl
2017/0280823 A1 * 10/2017 Langvin ..... A43B 9/12
2017/0360144 A1 * 12/2017 Lee ..... A43B 23/0295
2018/0110288 A1 4/2018 Hatfield et al.
2019/0142112 A1 * 5/2019 Ramsay ..... A43B 3/24 36/50.1
2019/0289963 A1 9/2019 Iuchi et al.
2019/0297988 A1 10/2019 Oden et al.
2021/0022447 A1 * 1/2021 Cobb ..... A43C 1/00
2021/0368919 A1 * 12/2021 Holmes ..... A43B 13/181

OTHER PUBLICATIONS

International Search Report and Written Opinion mailed in International Application No. PCT/US2021/012355, dated Mar. 26, 2021, 13 pages.
European Patent Office, Communication pursuant to Article 94(3) EPC, for European Patent Application No. 21 705 292.7-1015, dated Apr. 21, 2023, 9 pages.

* cited by examiner

ARTICLES OF FOOTWEAR WITH ADJUSTABLE DIMENSIONS

CROSS-REFERENCE TO RELATED APPLICATION

This application claims the benefit of U.S. Provisional Application No. 62/958,241, filed on Jan. 7, 2020, which is incorporated by reference herein.

FIELD

This disclosure relates generally to articles of footwear and more particularly to articles of footwear with adjustable dimensions.

BACKGROUND

An article of footwear (also referred to herein as "the article" or "the footwear") typically includes two main components: a sole structure and an upper. The sole structure is configured for supporting the wearer's foot and providing cushioning between the wearer's foot and the ground. The upper is coupled to the sole structure and is configured for securing the wearer's foot to the sole structure.

DETAILED DESCRIPTION

General Considerations

Figure 1:
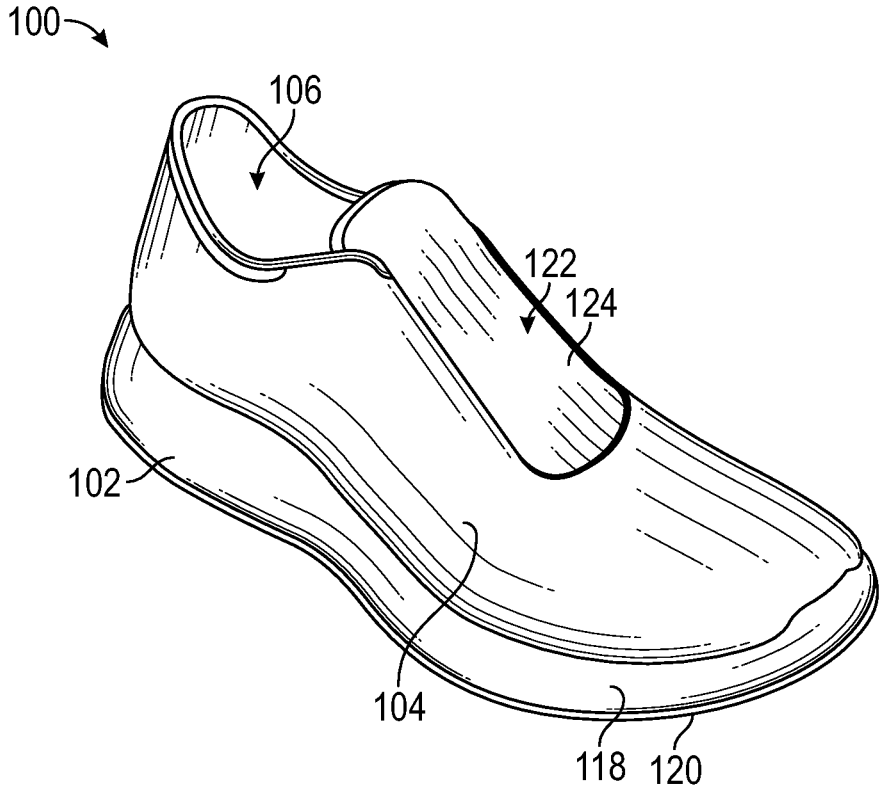
FIG. 1 is a perspective view of an exemplary article of footwear.

The systems and methods described herein, and individual components thereof, should not be construed as being limited to the particular uses or systems described herein in any way. Instead, this disclosure is directed toward all novel and non-obvious features and aspects of the various disclosed embodiments, alone and in various combinations and subcombinations with one another. For example, any features or aspects of the disclosed embodiments can be used in various combinations and subcombinations with one another, as will be recognized by an ordinarily skilled artisan in the relevant field(s) in view of the information disclosed herein. In addition, the disclosed systems, methods, and components thereof are not limited to any specific aspect or feature or combinations thereof, nor do the disclosed things and methods require that any one or more specific advantages be present or problems be solved.

As used in this application, the singular forms "a," "an," and "the" include the plural forms unless the context clearly dictates otherwise. Additionally, the term "includes" means "comprises." Further, the terms "coupled" or "secured" encompass mechanical and chemical couplings, as well as other practical ways of coupling or linking items together, and do not exclude the presence of intermediate elements between the coupled items unless otherwise indicated, such as by referring to elements, or surfaces thereof, being "directly" coupled or secured. Furthermore, as used herein, the term "and/or" means any one item or combination of items in the phrase.

As used herein, the term "exemplary" means serving as a non-limiting example, instance, or illustration. As used herein, the terms "e.g.," and "for example," introduce a list of one or more non-limiting embodiments, examples, instances, and/or illustrations.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not depict the various ways in which the disclosed things and methods can be used in conjunction with other things and methods. Additionally, the description sometimes uses terms like "provide" and "produce" to describe the disclosed methods. These terms are high-level descriptions of the actual operations that are performed. The actual operations that correspond to these terms will vary depending on the particular implementation and are readily discernible by one of ordinary skill in the art having the benefit of this disclosure.

As used herein, the directional terms (e.g., "upper" and "lower") generally correspond to the orientation of an article of footwear or sole assembly as it is configured to be worn by a wearer. For example, an "upwardly-facing surface" and/or an "upper surface" of a sole assembly refers to the surface oriented in the "superior" anatomical direction (i.e., toward the head of a wearer) when the article of footwear is being worn by the wearer. Similarly, the directional terms "downwardly" and/or "lower" refer to the anatomical direction "inferior" (i.e., toward the ground and away from the head of the wearer). "Front" means "anterior" (e.g., towards the toes), and "rear" means "posterior" (e.g., towards the heel). "Medial" means "toward the midline of the body," and "lateral" means "away from the midline of the body." "Longitudinal axis" refers to a centerline of the article from the heel to toe. Similarly, a "longitudinal length" refers to a length of the article along the longitudinal axis and a "longitudinal direction" refers to a direction along the longitudinal axis.

As used herein, the term "sole structure" refers to any combination of materials that provides support for a wearer's foot and bears the surface that is in direct contact with the ground or playing surface, such as, for example, a single sole; a combination of an outsole and an inner sole; a combination of an outsole, a midsole, and an inner sole; and a combination of an outer covering, an outsole, a midsole and an inner sole.

As used herein, the terms "attached" and "coupled" generally mean physically connected or linked, which includes items that are directly attached/coupled and items that are attached/coupled with intermediate elements between the attached/coupled items, unless specifically stated to the contrary.

As used herein, the terms "fixedly attached" and "fixedly coupled" refer to two components joined in a manner such that the components may not be readily separated from one another without destroying and/or damaging one or both of the components. Exemplary modalities of fixed attachment may include joining with permanent adhesive, stitches, welding or other thermal bonding, and/or other joining techniques. In addition, two components may be "fixedly attached" or "fixedly coupled" by virtue of being integrally formed, for example, in a molding process. In contrast, the terms "removably attached" or "removably coupled" refer to two components joined in a manner such that the components can be readily separated from one another to return to their separate, discrete forms without destroying and/or damaging either component. Exemplary modalities of temporary attachment may include mating-type connections, releasable fasteners, removable stitches, and/or other temporary joining techniques.

As used herein, the terms "articles of footwear," "articles," and/or "footwear" mean any type of footwear, including, for example, casual shoes, walking shoes, sneakers, tennis shoes, running shoes, soccer shoes, football shoes, rugby shoes, basketball shoes, baseball shoes, boots, sandals, etc.

Although the figures may illustrate an article of footwear intended for use on only one foot (e.g., a right foot) of a wearer, one skilled in the art and having the benefit of this disclosure will recognize that a corresponding article of footwear for the other foot (e.g., a left foot) would be a mirror image of the right article of footwear.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the detailed description, abstract, and drawings.

The Disclosed Technology

An article of footwear typically includes two main components: a sole structure and an upper. The sole structure is configured for supporting the wearer's foot and providing cushioning between the wearer's foot and the ground. The upper is coupled to the sole structure and forms a foot-receiving cavity. The upper is configured for securing the wearer's foot to the sole structure and/or can protect the wearer's foot.

Figure 2:
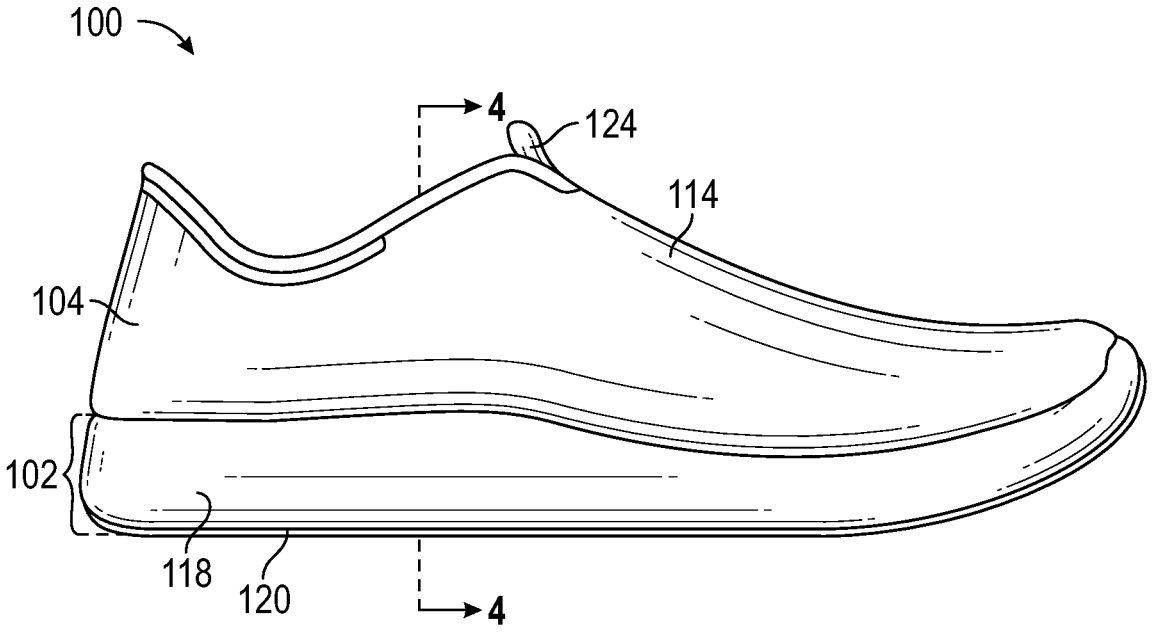
FIG. 2 is a side elevation view of a lateral side of the footwear of FIG. 1.
Figure 3:
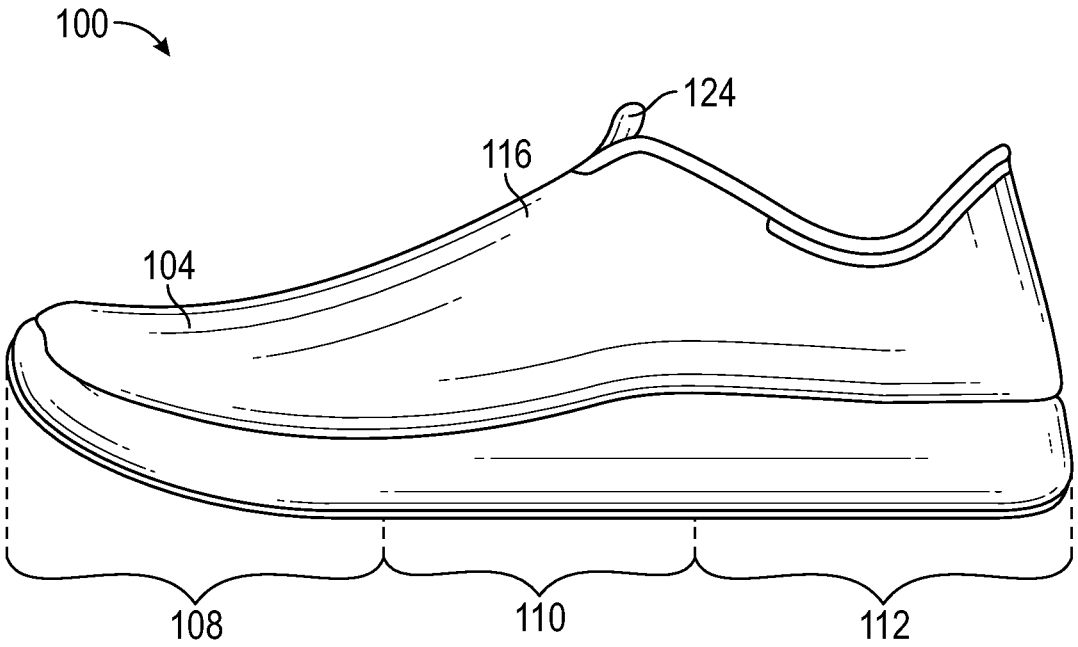
FIG. 3 is a side elevation view of a medial side of the footwear of FIG. 1.
Figure 4:
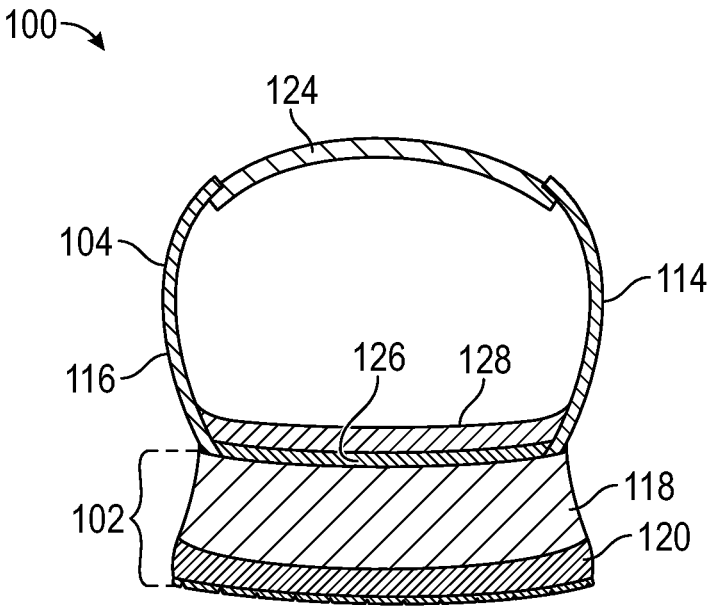
FIG. 4 is a cross-sectional view of the footwear of FIG. 1, taken along the line 4-4 as depicted in FIG. 2.
Figure 5:
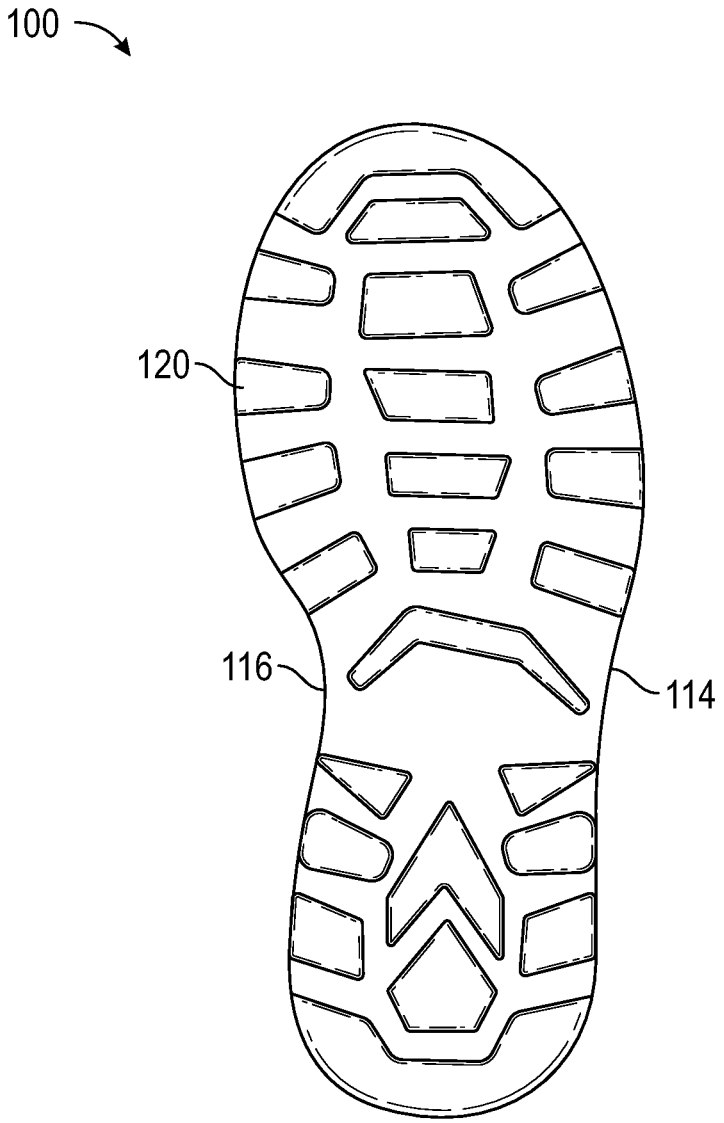
FIG. 5 is a bottom plan view of the footwear of FIG. 1.

For example, FIGS. 1-5 depict an article of footwear 100, according to one embodiment. The article of footwear 100 can also be referred to as "the article 100" or "the footwear 100." FIG. 1 depicts a perspective view of the footwear 100. FIG. 2 depicts an elevation view of a lateral side of the footwear 100. FIG. 3 depicts an elevation view of a medial side of the footwear 100. FIG. 4 depicts a cross-sectional view of the footwear 100, taken along the line 4-4 as depicted in FIG. 2. FIG. 5 depicts a bottom plan view of the footwear 100.

Referring to FIG. 1, the footwear 100 comprises a sole structure 102 and an upper 104. The upper 104 is coupled to and extends from the sole structure 102 so as to form a foot-receiving cavity 106 between the sole structure 102 and the upper 104. The foot-receiving cavity 106 can be widened to make it easier for a wearer to insert their foot into the foot-receiving cavity 106. The foot-receiving cavity 106 can also be tightened to secure the wearer's foot within the foot-receiving cavity 106. In some embodiments, the upper 104 can comprise stretchable material to allow the foot-receiving cavity 106 to widen while the wearer is inserting their foot into the foot-receiving cavity 106. In some embodiments, the footwear 100 can comprise a closure system to accommodate widening and/or tightening of the foot-receiving cavity 106. Exemplary closure systems include laces, straps, bands, cables, cords, ratcheting mechanisms, hook-and-loop, etc.

The footwear 100 may be divided into one or more portions (which may also be referred to as "zones" or "regions"). For example, referring to FIG. 3, the portions can include a forefoot portion 108, a midfoot portion 110, and a heel portion 112. The forefoot portion 108 of the footwear 100 can correspond to anterior portions of a foot, including toes and joints connecting metatarsal bones with phalanx bones of the foot. The midfoot portion 110 of the footwear 100 can correspond with an arch area of the foot. The heel portion 112 of the footwear 100 can correspond with posterior portions of the foot, including a calcaneus bone.

The footwear 100 can also be divided into a lateral side 114 and a medial side 116, both of which extend through the forefoot portion 108, the midfoot portion 110, and the heel portion 112. For example, FIG. 2 depicts the lateral side 114 of the footwear 100, and FIG. 3 depicts the medial side 116 of the footwear 100.

Referring now to FIG. 4, the sole structure 102 of the footwear 100 comprises a midsole 118 and an outsole 120. In the illustrated embodiment, the midsole 118 and the outsole 120 are formed as separate components that are fixedly coupled together. This can be accomplished in various ways, including with adhesive, fasteners, stitching, and/or other means for fastening. In other embodiments, the midsole 118 and the outsole 120 can be integrally formed as a unitary component.

The midsole 118 of the sole structure 102 is configured to be positioned under the wearer's foot. As such, the midsole 118 can, for example, be configured to provide cushioning and support. The midsole 118 can be configured to flex and/or elastically deform as wearer's foot applies pressure upon the midsole 118 and/or as the footwear 100 impacts a ground surface. In some embodiments, the midsole 118 can comprise relatively flexible foam material.

The outsole 120 of the sole structure 102 is configured to be positioned between the midsole 118 and the ground surface. Accordingly, the outsole 120 can, for example, be configured to provide increased traction and/or to protect the midsole 118. In some embodiments, the outsole 120 can comprise various traction elements (e.g., nubs, ribs, cleats, lugs, patterns, etc.) configured for engaging one or more types of ground surfaces. In some embodiments, the outsole 120 can comprise a flexible polymeric material (e.g., rubber).

In some embodiments, the sole structure 102 can also comprise one or more additional components. For example, the sole structure 102 can include one or more cushioning elements (e.g., a fluid-filled capsule such as an airbag) and/or foam member (e.g., a foam pad).

Referring to FIG. 1, the upper 104 comprises a throat portion 122 separating the lateral side of the upper 104 and the medial side of the upper 104. The upper 104 also comprises a tongue 124 disposed at least partially within the throat portion 122. In other embodiments, the upper 104 can be formed without a throat portion and/or a tongue.

The upper 104 of the footwear 100 can be formed of various materials. For example, the upper 104 can be formed of one or more of the following materials: textiles, foam, leather, polymers, and/or synthetic leather. In some embodiments, the upper 104 can be formed as a single, unitary component (e.g., by knitting or molding). In other embodiments, the upper 104 can comprise a plurality of components that are coupled together (e.g., by stitching, adhesive, fasteners, etc.).

The upper 104 can be fixedly coupled to the sole structure 102 in various ways. For example, as depicted in FIG. 4, the upper 104 is attached (e.g., stitched) to a strobel 126, and the strobel 126 is attached to the midsole 118 (e.g., with an adhesive). In other embodiments, the strobel can be omitted, and the upper 104 can be attached to a component of the sole structure 102. In some such embodiments, the upper 104 can be attached to the midsole 118 and/or a cushioning element (e.g., an airbag) of the sole structure 102 via adhesive, stitching, and/or other means for coupling.

As depicted, the footwear 100 further comprises a sockliner 128 (which may also be referred to as "an insole"). The sockliner 128 is configured to be positioned directly underfoot and is configured to cushion and/or support the wearer's foot. The sockliner 128 can comprise various materials including textile, leather, foam, and/or other types of materials.

The footwear 100 can be configured in one or more sizes (e.g., U.S. women's size 4-12) and/or widths (e.g., A, B, C, D, E, EE, and/or EEE). The footwear 100 can also be also be configured in other sizing conventions (e.g., UK, EUR, cm, etc.) and/or sizes (e.g., U.S. men's size 1-18).

Under normal circumstances, the dimensions of a wearer's feet can change throughout the day and/or over the course of an activity. Such changes in dimensions can include slight swelling (i.e., expansion) of the feet. Typical footwear can accommodate slight variation in the dimensions of the wearer's feet. In some circumstances, however, the dimensions of the wearer's feet may change relatively more drastically. These circumstances may include pregnancy, growth, injury, and/or other circumstances or conditions that result in changes in the dimensions of a person's feet. Such circumstances may result in the dimensions of a wearer's feet changing beyond the tolerance afforded by a single size of footwear. Thus, a person experiencing these circumstances or conditions may be required to purchase and/or frequently change sizes of footwear. This can be particularly problematic during circumstances in which a person's feet change sizes relatively quickly (e.g., throughout the day and/or during a pregnancy).

Unlike typical footwear, the dimensions of the articles of footwear disclosed herein can adjust and/or or be adjusted to account for relatively large changes and/or fluctuation in the dimensions of a wearer's feet. Accordingly, the disclosed footwear can, for example, improve comfort. It can also reduce the need for multiple sizes and/or increase the range of feet that can be accommodated by a single size of footwear.

This disclosure is directed to articles of footwear with adjustable dimensions. More specifically, in some embodiments, the articles of footwear disclosed herein comprise sole structures with adjustable dimensions. In other embodiments, the articles of footwear disclosed herein comprise other components (e.g., uppers) with adjustable dimensions.

For example, in one representative embodiment, an article of footwear includes an upper and a sole structure coupled to the upper and forming a foot-receiving cavity therebetween. The sole structure includes one or more tapered sidewalls, and the one or more tapered sidewalls partially define the foot-receiving cavity. In certain embodiments, the article of footwear further includes one or more insert members disposed in the foot-receiving cavity and configured to contact the one or more tapered sidewalls.

In some embodiments, an article of footwear includes a sole structure with flared side portions that can move outwardly and/or inwardly to expand and/or compress the sole structure. For example, in one representative embodiment, an article of footwear includes an upper and a sole structure coupled to the upper and forming a foot-receiving cavity therebetween. The sole structure includes one or more flexible sidewalls, and the one or more flexible sidewalls partially define the foot-receiving cavity. The one or more flexible sidewalls move between an undeflected state to a deflected state to accommodate feet of various dimensions. The foot-receiving cavity is wider when the one or more flexible sidewalls are in the deflected state than when the one or more flexible sidewalls are in the undeflected state.

In some embodiments, an article of footwear includes one or more removable inserts configured for adjusting the dimensions of a foot-receiving cavity of the article of footwear. For example, in one representative embodiment, an article of footwear includes an upper, a sole structure coupled to the upper, and one or more removable insert members. The upper, the sole structure, and the one or more removable insert members at least partially define a foot-receiving cavity therebetween. The one or more removable insert members are configured for altering one or more dimensions of the foot-receiving cavity.

In some embodiments, an assembly is provided. The assembly includes an article of footwear, one or more first insert members, and one or more second insert members. The first and second insert members can be removably coupled to the article of footwear and are interchangeable.

In some embodiments, an article of footwear includes flexible side supports that are configured to support the upper when the upper expands. For example, in one representative embodiment, an article of footwear includes an upper and a sole structure coupled to the upper and forming a foot-receiving cavity therebetween. The sole structure includes a midsole and an outsole. The outsole comprises a base portion and one or more flexible side supports. The base portion of the outsole is coupled to an inferior surface of the midsole. The one or more flexible side supports of the outsole extend from the base portion and are coupled to the upper. The one or more flexible side supports are movable relative to the midsole between a compressed configuration and an expanded configuration.

In some embodiments, an article of footwear includes a sole structure with one or more pivoting members. The pivoting members can, in some states, contact a ground surface, thereby widening the sole structure. For example, in one representative embodiment, an article of footwear includes an upper and a sole structure coupled to the upper and forming a foot-receiving cavity therebetween. The sole structure includes one or more flexible extension members extending therefrom. The one or more flexible extension members are pivotable from a disengaged state to an engaged state. The foot-receiving cavity is wider when the one or more flexible extension members are in the engaged state than when the one or more flexible extension members are in the disengaged state.

In some embodiments, an article of footwear includes one or more folding structures. For example, in one representative embodiment, an article of footwear includes an upper and a sole structure coupled to the upper and forming a foot-receiving cavity therebetween. The sole structure includes one or more flexible extension members extending therefrom. The one or more flexible extension members are foldable between a compressed state and an expanded state. In the compressed state, the one or more flexible extension members extend at least partially over the upper. In the expanded state, the one or more flexible extension members comprise one or more portions configured for contacting a ground surface.

Additional examples of the disclosed technology are described below with reference to the accompanying drawings.

Exemplary Embodiments of the Disclosed Technology

Figure 6:
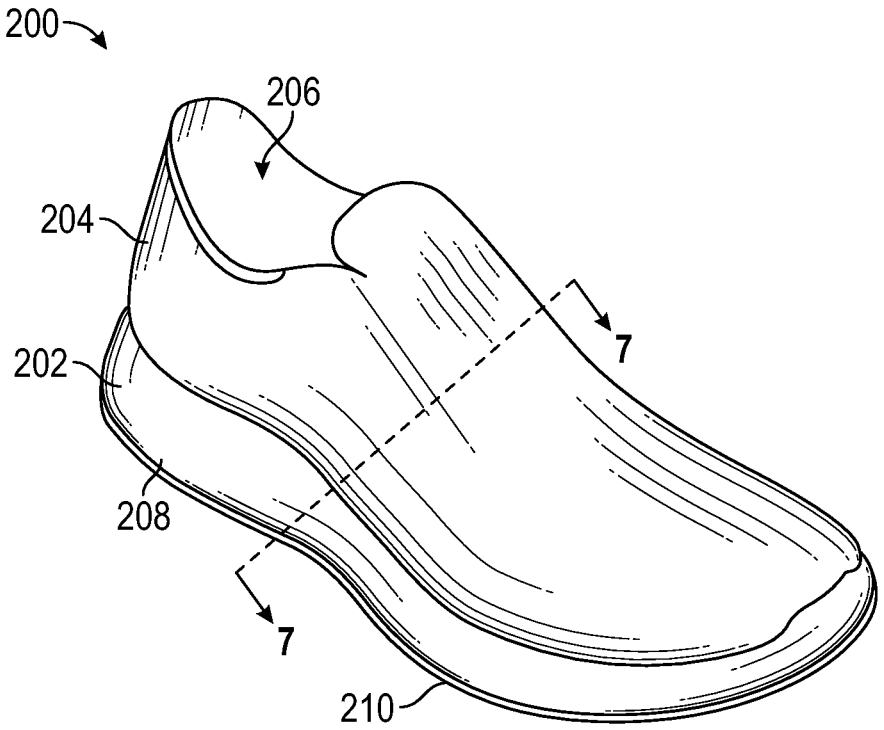
FIG. 6 is a perspective view of an exemplary article of footwear.
Figure 7:
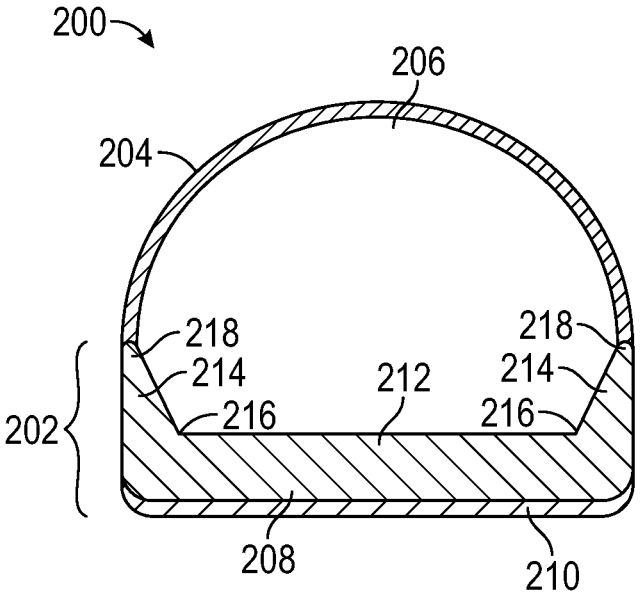
FIG. 7 is a cross-sectional view of the footwear of FIG. 6, taken along the line 7-7 as depicted in FIG. 6.
Figure 8:
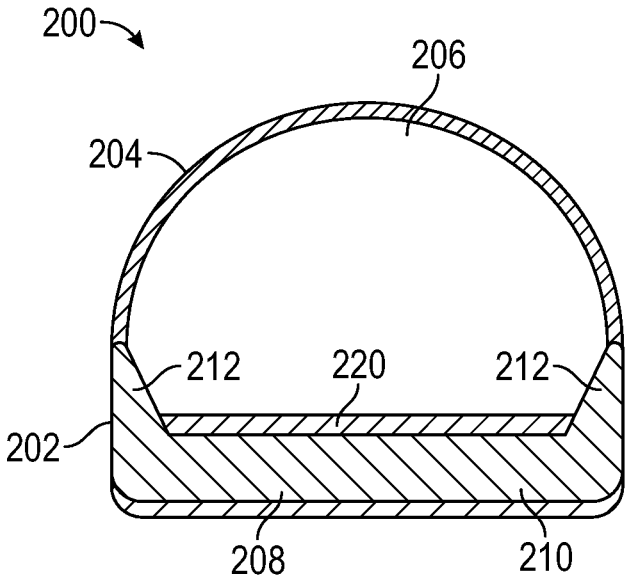
FIG. 8 is a cross-sectional view of the footwear of FIG. 6, depicting a first insert member disposed in a foot-receiving cavity of the footwear.
Figure 9:
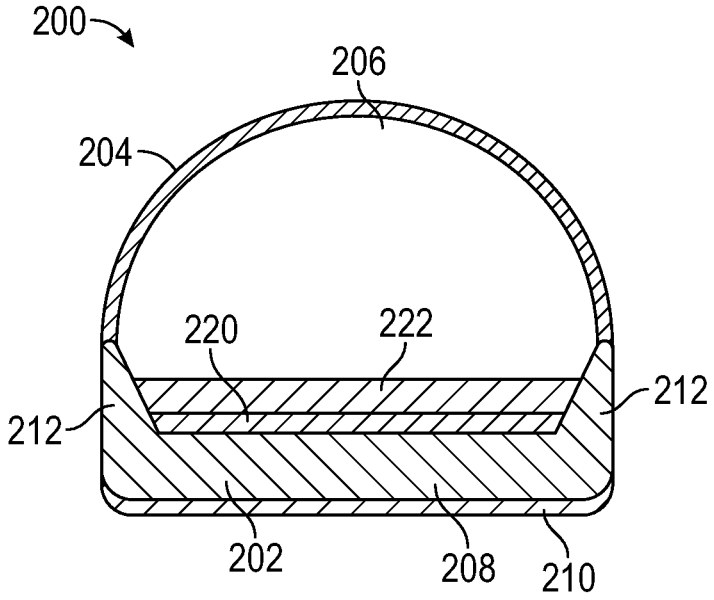
FIG. 9 is a cross-sectional view of the footwear of FIG. 6, depicting the first insert member and a second insert member disposed in the foot-receiving cavity of the footwear.

FIGS. 6-9 depict an article of footwear 200. Referring to FIG. 6, the footwear 200 comprises a sole structure 202 and an upper 204. The upper 204 is coupled to the sole structure 202 so as to form a foot-receiving cavity 206 therebetween. Referring to FIG. 7, the sole structure 202 comprises various internal widths configured for accommodating feet of various widths within the foot-receiving cavity 206. Referring to FIGS. 8-9, in some embodiments, one or more insert members can be provided to adjust a width and/or a height of the foot-receiving cavity 206. Additional details are provided below.

Referring again to FIG. 7, the sole structure 202 comprises a midsole 208 and an outsole 210. The outsole 210 can be coupled to an inferior portion of the midsole 208, and the upper 204 can be coupled to and extend from a superior portion of the midsole 208.

Referring still to FIG. 7, the midsole 208 of the sole structure 202 comprises an interior portion partially defining the foot-receiving cavity 206. The interior portion of the midsole 208 comprises a base portion 212 and sidewalls 214 extending away from the base portion 212 in a superior direction. The sidewalls 214 taper outwardly from inferior portions 216 of the sidewalls 214 that are adjacent to the base portion 212 to superior portions 218 of the sidewalls 214 that are adjacent to the upper 204. In this manner, a width dimension (i.e., in a medial/lateral direction) of the interior portion of the midsole 208 (and the foot-receiving cavity 206) increases as a height dimension (i.e., in a superior/inferior direction) of the midsole 208 increases.

Thus, a wearer with a relatively narrow foot can insert their foot into the foot receiving cavity and position their foot on or adjacent the base portion 212 of the midsole 208. The inferior portions 216 of the sidewalls 214 can contact and/or support the medial and lateral sides of the wearer's foot.

If a wearer's foot is relatively wider, one or more insert members (which may also be referred to as "spacer members") can be inserted into the foot-receiving cavity 206 to position the wearer's foot at a wider location of the sidewalls 214. For example, FIG. 8 depicts a first insert member 220 disposed on the base portion 212 and the sidewalls 214 of the midsole 208. FIG. 9 depicts a second insert member 222 disposed on the first insert member 220. The configuration depicted in FIG. 8 provides a wider foot-receiving cavity than the foot-receiving cavity provided by the configuration depicted in FIG. 7. The configuration depicted in FIG. 9 provides a wider foot-receiving cavity than the foot-receiving cavities provided by the configurations depicted in FIG. 7 and FIG. 8.

In the configuration depicted in FIG. 9, the second insert member 222 is stacked on the first insert member 220. In some such embodiments, the insert members can comprise mating features (e.g., holes and pins) configured for releasably coupling a plurality of insert members together and/or for restricting relative movement between the insert members. In other embodiments, the insert members can be exchanged for one another rather than stacked.

In the illustrated embodiment, the insert members 220, 222 comprise tapered side surfaces configured to nest with the tapered sidewalls 214 of the midsole 208. In other words, the insert members 220, 222 generally comprise a frustum shape and/or have an isosceles trapezoid cross-sectional profile. In other embodiments, the insert members can comprise various other shapes.

The insert members can comprise various thicknesses. For example, the first insert member 220 comprises a first thickness, and the second insert member 222 comprises a second thickness, which is greater than the first thickness. Insert members having thicknesses less than or greater than the first and/or second thicknesses can be provided.

Although not shown, the footwear 200 can, in some embodiments, further comprise a strobel and/or a sockliner. The strobel can be coupled to the midsole 208 and the upper 204. The sockliner can be disposed within the foot-receiving cavity 206. In some embodiments comprising a sockliner, the sockliner can be disposed between the wearer's foot and the midsole and/or strobel. In other embodiments comprising a sockliner, the sockliner can be disposed between the wearer's foot and one or more insert members, which are disposed on the midsole.

In some embodiments, an insert member and the sockliner can be fixedly coupled together and/or can be formed as a single component. For example, an insert member and a sockliner can be fixedly coupled together with fasteners, adhesive, and/or other means for coupling. In other embodiments, the sockliner and the insert member are formed as a unitary structure. In other words, the sockliner is the insert member, and vice versa.

A wearer of the footwear 200 can adjust the width of the footwear by adding or removing the insert members. For example, a user with a relatively narrow foot can use the footwear 200 without any insert members. If the wearer's foot gets wider (e.g., during pregnancy), the wearer can insert one or more insert members into the footwear 200. This can be accomplished, for example, by removing the sockliner of the footwear and positioning one or more insert members against the midsole 208 (and/or the strobel). If the wearer's foot later returns to a narrow state (e.g., following pregnancy), the wearer can simply remove one or more of the insert members. In this manner, the footwear 200 provides adjustability that can accommodate changes to the wearer's foot that is beyond the adjustability of typical footwear.

Figure 10:
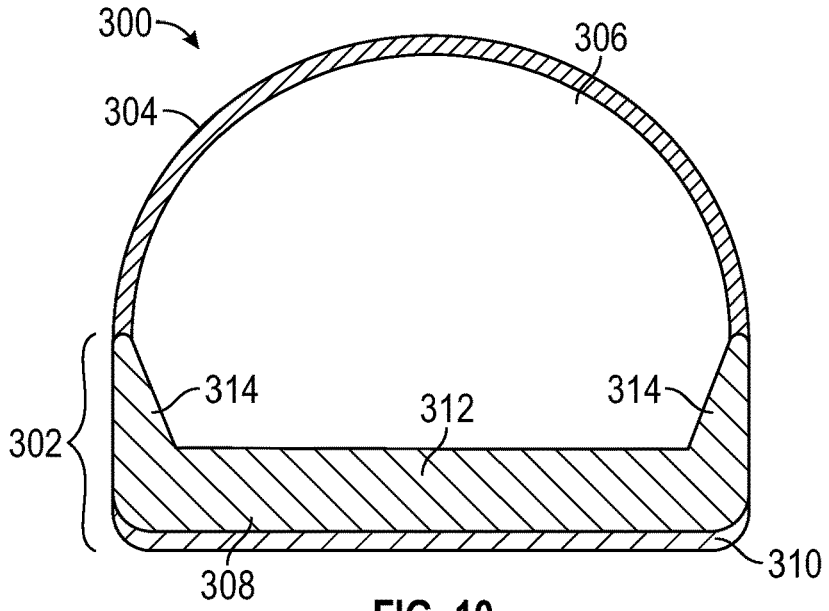
FIG. 10 is a cross-sectional view of another exemplary article of footwear, depicting the footwear in an undeflected or compressed state.
Figure 11:
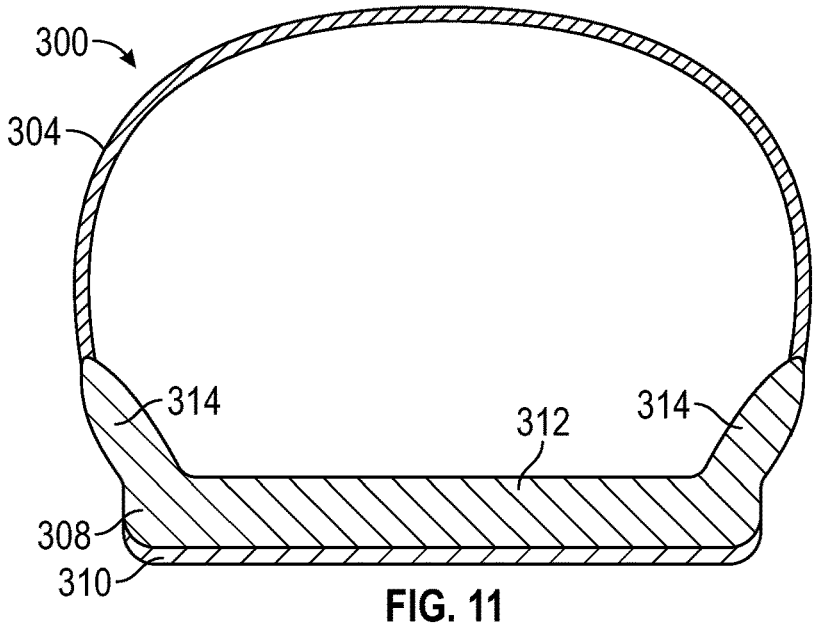
FIG. 11 is a cross-sectional view of the footwear of FIG. 10, depicting the footwear in a first deflected or expanded state.
Figure 12:
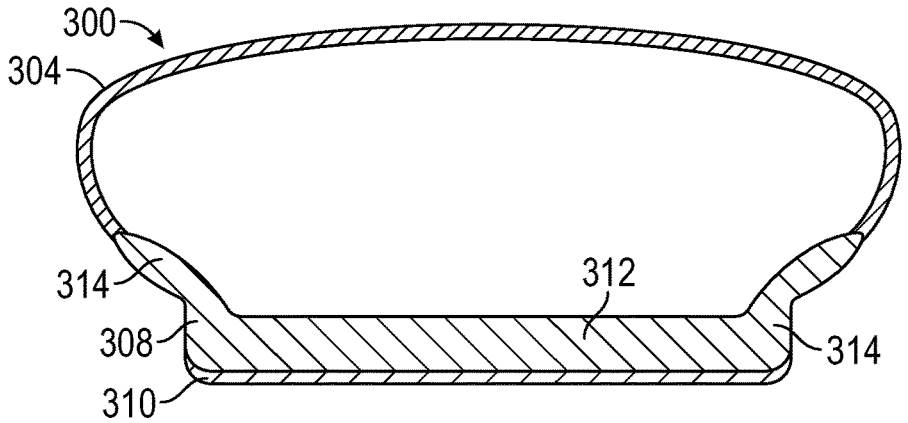
FIG. 12 is a cross-sectional view of the footwear of FIG. 10, depicting the footwear in a second deflected or expanded state.

FIGS. 10-12 depict an article of footwear 300 (shown in cross-section), which is generally similar to the footwear 200. Referring to FIG. 10, the footwear 300 comprises a sole structure 302 and an upper 304. The upper 304 is coupled to the sole structure 302 so as to form a foot-receiving cavity 306 therebetween. As depicted in FIGS. 10-12, the sole structure 302 comprises flexible sidewalls that can deflect as forces (e.g., from a wearer's foot) are applied to the sidewalls. The flexible sidewalls can, for example, allow the internal width of the foot-receiving cavity 306 to vary to accommodate feet of various widths. Additional details are provided below.

Referring again to FIG. 10, the sole structure 302 comprises a midsole 308 and an outsole 310. The outsole 310 can be coupled to an inferior portion of midsole 308, and the upper 304 can be coupled to and extend from a superior portion of the midsole 308.

Referring still to FIG. 10, the midsole 308 of the sole structure 302 comprises an interior portion partially defining the foot-receiving cavity 306. The interior portion of the midsole 308 comprises a base portion 312 and sidewalls 314 extending away from the base portion 312 in a superior direction. In the illustrated embodiment, the sidewalls 314 taper outwardly from the base portion 312 toward the upper 304. The degree of taper can vary. In other embodiments, the sidewalls can be vertical or at least substantially vertical.

The sidewalls 314 of the midsole 308 are formed of a relatively flexible material. As such, the sidewalls 314 can deflect or flare outwardly when outwardly-directed forces are exerted thereon. For example, FIG. 11 depicts the sidewalls 314 flaring outwardly to a first extent relative to the normal or undeflected state depicted in FIG. 10. As another example, FIG. 12 depicts the sidewalls 314 flaring outwardly to a second extent relative to the normal or undeflected state depicted in FIG. 10, which is greater than the state depicted in FIG. 11.

Outwardly-directed forces can be applied to the sidewalls 314 of the midsole 308, for example, by a wearer's foot. For example, if a wearer's foot is as narrow or narrower than a width defined by the distance between the sidewalls 314 of the midsole 308 in an undeflected state (e.g., FIG. 10), the wearer's foot can sit between the sidewalls 314 and will exert relatively small or no outwardly directed forces on the sidewalls 314. As such, the sidewalls 314 will remain in the undeflected state. If a wearer's foot is or becomes relatively wider than the sidewalls 314 in the undeflected state, the wearer's foot will contact the sidewalls 314. If the force exerted by the wearer's foot is sufficient, the sidewalls 314 will deflect outwardly (e.g., FIGS. 11-12) to adapt to the width of the wearer's foot. After being deflected, the sidewalls 314 are sufficiently resilient so that they can return to their undeflected state when the outwardly-directed forces on the sidewalls 314 are removed. In this manner, the footwear 300 can adapt to a wider range of widths than typical footwear.

The sidewalls 314 can be configured so as to deflect outwardly to and/or remain in the deflected state when the wearer is in a stationary, standing position. In other words, the wearer's weight alone is sufficient to move the sidewalls 314 to or retain the sidewalls 314 in the deflected state. This differentiates the footwear 300 from typical footwear in which a portion of the footwear (e.g., the midsole) may elastically deform to at least some extent when the wearer is moving (e.g., walking, running, jumping, etc.), which applies greater force to the footwear than when a wearer is stationary. These same principles apply to other footwear with flexible and/or deflectable components that are described herein.

In some embodiments, the upper 304 can be formed of a relatively stretchable material. This can, for example, allow the upper 304 to conform to the wearer's foot as the sole structure deflects to various states. Like the sole structure, the upper 304 can be configured so as to deflect outwardly when the wearer is in a stationary, standing position. In other words, the wearer's weight alone is sufficient to cause the upper to stretch.

Figure 13:
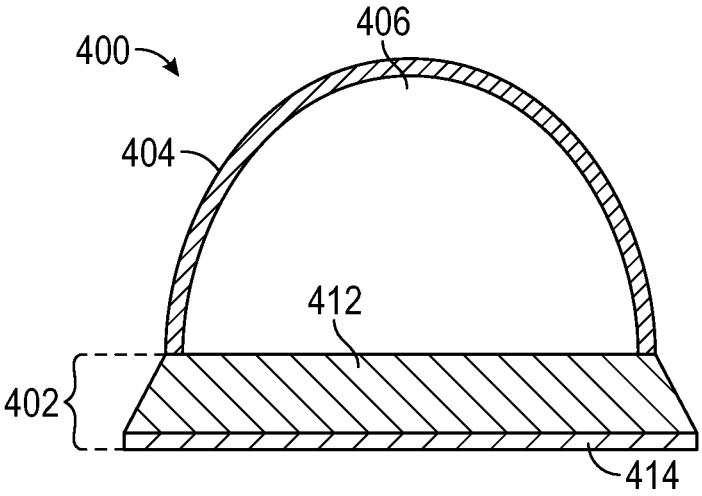
FIG. 13 is a cross-sectional view of another exemplary article of footwear.
Figure 14:
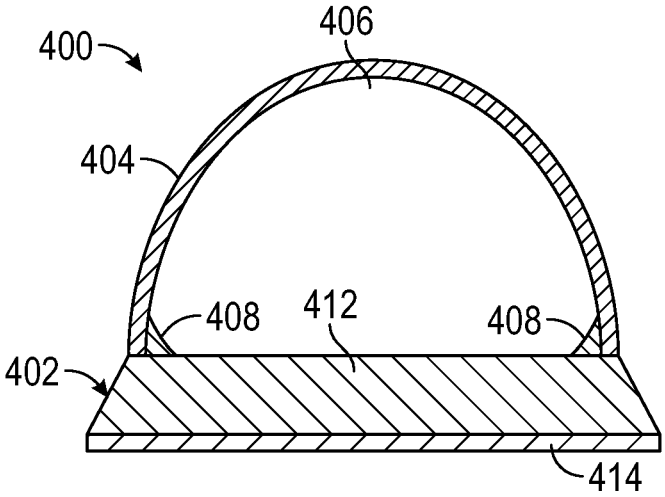
FIG. 14 is a cross-sectional view of the footwear of FIG. 13, depicting first insert members disposed in a foot-receiving cavity of the footwear.
Figure 15:
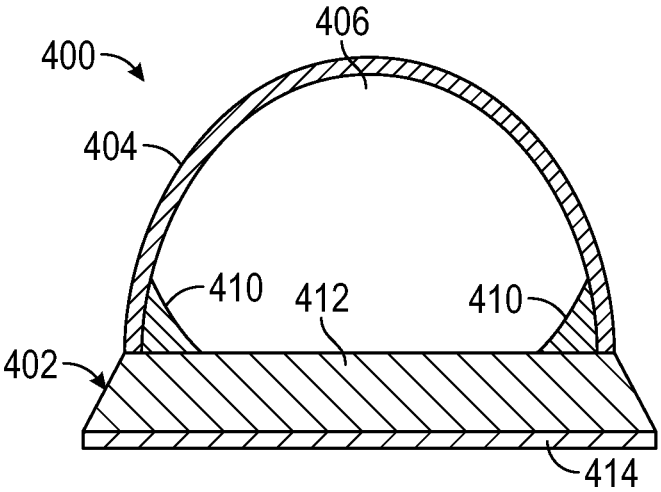
FIG. 15 is a cross-sectional view of the footwear of FIG. 13, depicting second insert members disposed in the foot-receiving cavity of the footwear.

FIGS. 13-15 depict an article of footwear 400 (shown in cross-section). The footwear 400 comprises a sole structure 402 and an upper 404. The upper 404 is coupled to the sole structure 402 so as to form a foot-receiving cavity 406 therebetween. As depicted in FIGS. 14-15, one or more insert members (e.g., first insert members 408 and second insert members 410) can be disposed in the foot-receiving cavity 406. The insert members can comprise various dimensions and can therefore be used to adjust a width dimension of the foot-receiving cavity 406. For example, FIG. 13 depicts the footwear 400 without any insert member. In this configuration, the foot-receiving cavity 406 is the widest of the depicted configurations. FIG. 14 depicts the footwear 400 with the first insert members 408 disposed in the foot-receiving cavity 406. In this configuration, the foot-receiving cavity 406 is narrower than the configuration depicted in FIG. 13. FIG. 15 depicts the footwear 400 with the second insert members 410 disposed in the foot-receiving cavity 406. In this configuration, the foot-receiving cavity 406 is narrower than the configurations depicted in FIG. 13 and FIG. 14. In this manner, a wearer can adjust the width of the footwear 400 the insert members the footwear 400 can accommodate feet of various widths. Additional details are provided below.

The sole structure 402 comprises a midsole 412 and an outsole 414. The midsole 412 can be configured to provide cushioning under the wearer's foot. The upper 404 can be coupled to the midsole 412 (e.g., via adhesive and/or a strobel). The outsole 414 can be configured for protecting the midsole 412, providing additional support to the wearer's foot, and/or engaging a ground surface.

The insert members 408, 410 can be disposed in the foot-receiving cavity 406. The insert members can be coupled to the footwear in a manner that allows them to be interchanged and/or removed. In some embodiments, the insert members can simply sit inside the foot-receiving cavity 406 and rely upon the wearer's foot to sandwich the insert members against the sides of the upper 404. In other embodiments, the insert members can be removably coupled to the upper 404, a strobel, and/or the midsole 412. For example, the insert members and the midsole can include one or more types of mating features configured for removably coupling the components together. Such mating features include male-female type mating features (e.g., pins and openings).

The insert members 408, 410 are configured for adjusting the width dimension of the footwear 400. In other embodiments, the insert members can be configured for adjusting one or more other dimensions of the footwear 400. As one example, the insert members can be configured to be disposed in a toe and/or heel of the footwear 400, and thereby adjust a length dimension of the footwear 400. As another example, an insert member can be configured to extend around a portion or the entire periphery of the foot-receiving cavity 406. In such examples, the insert member can use to adjust the width and/or length dimensions.

Figure 16:
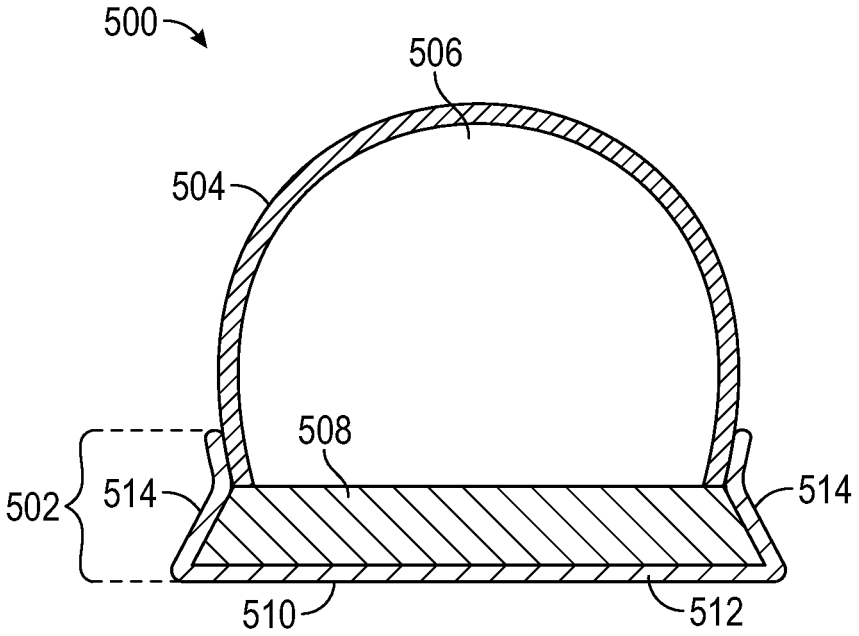
FIG. 16 is a cross-sectional view of another exemplary article of footwear, depicting the footwear in an undeflected or compressed state.
Figure 17:
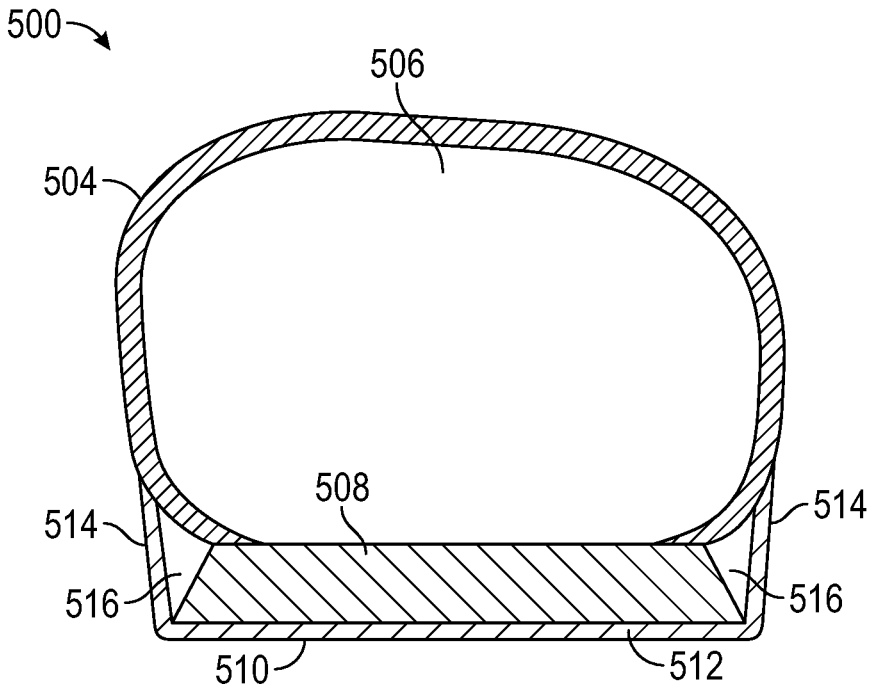
FIG. 17 is a cross-sectional view of the footwear of FIG. 16, depicting the footwear in a deflected or expanded state.

FIGS. 16-17 depict an article of footwear 500 (shown in cross-section). The footwear 500 comprises a sole structure 502 and an upper 504. The upper 504 is coupled to the sole structure 502 so as to form a foot-receiving cavity 506 therebetween. As depicted, the sole structure 502 comprises flexible sidewalls that can move between a compressed configuration (e.g., FIG. 16) and an expanded configuration (e.g., FIG. 17). In the expanded state, the sole structure 502 flares outwardly and can help support the wearer's foot. In this manner, the footwear 500 can accommodate feet of various widths. Additional details are provided below.

The sole structure 502 comprises a midsole 508 and an outsole 510. The midsole 508 can be configured to provide cushioning under the wearer's foot. The upper 504 can be coupled to the midsole 508 in various ways (e.g., via adhesive and/or a strobel). The outsole 510 can be configured for protecting the midsole 508, providing additional support to the wearer's foot, and/or engaging a ground surface. The outsole 510 includes a base portion 512 and a plurality of support wings 514 extending in a superior direction from the base portion 512. For example, in the illustrated embodiment, the outsole 510 comprises two support wings, i.e., a first support wing on the medial side of the footwear 500 and a second support wing on the lateral side of the footwear 500.

It should be noted that the support wings 514 of the outsole 510 can also be referred to as "side supports," "support members," or "flexible sidewalls."

The base portion 512 of the outsole 510 is coupled to an inferior surface of the midsole 508. This can be accomplished in various ways, including adhesive, stitching, fasteners, and/or other means for coupling. The base portion 512 can comprise various materials and can be configured for engaging a ground surface.

The support wings 514 of the outsole 510 extend from the base portion 512 of the outsole 510 and are coupled to the sides of the upper 504. As depicted in FIG. 17, the support wings 514 are not directly coupled to the sides of the midsole 508. This allows the support wings 514 to move between the compressed configuration (FIG. 16) and the expanded configuration (FIG. 17). In the compressed configuration, the support wings 514 contact the sides of the midsole 508. In the expanded configuration, the support wings 514 flare outwardly away from the midsole 508. In some instances, there are gaps 516 that form between the support wings 514 and the sides of the midsole 508 when the support wings 514 expand outwardly. The support wings 514 can move to the expanded configuration, for example, when a wearer's foot causes the upper 504 to expand outwardly beyond the midsole 508. This can occur, for example, when the wearer's foot is or becomes wider than the superior surface of the midsole 508. If the wearer's foot is or becomes narrow, the support wings 514 can "fold" inwardly and return to the compressed state.

The support wings 514 can be formed of a relatively flexible and/or elastic material so that the support wings 514 can move between the compressed and expanded configurations. The support wings 514 can also be formed of a relatively rigid material so that the support wings 514 can help to support the portion of the wearer's foot that extends beyond the midsole 508. Exemplary materials for the support wings 514 include various polymeric materials (e.g., rubber).

In some embodiments, the support wings 514 can be integrally formed with the base portion 512 of the outsole 510. In some such embodiments, the support wings 514 and the base portion 512 can be formed of the same material. In other such embodiments, the support wings 514 and the base portion 512 can be formed of different materials that are co-molded together. In other embodiments, the support wings 514 and the base portion 512 can be formed as separate components that are coupled together. For example, the support wings 514 and the base portion 512 can be coupled together with adhesive, fasteners, stitching, and/or other coupling means.

The upper 504 can be formed of a sufficiently stretchable material to accommodate various foot widths and/or to allow the sole structure to move between the expanded configuration and the compressed configuration. Exemplary materials for the upper comprise various woven or knit materials comprising elastomeric material such as spandex.

Figure 18:
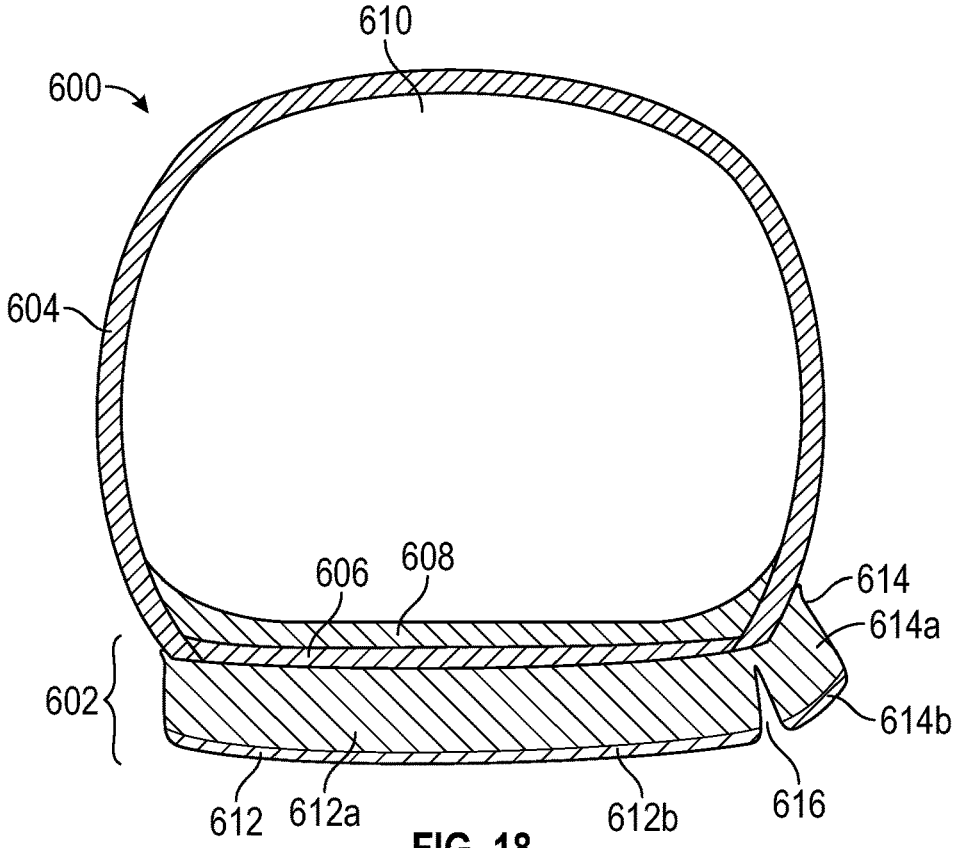
FIG. 18 is a cross-sectional view of another exemplary article of footwear, depicting the footwear in an undeflected or compressed state.
Figure 19:
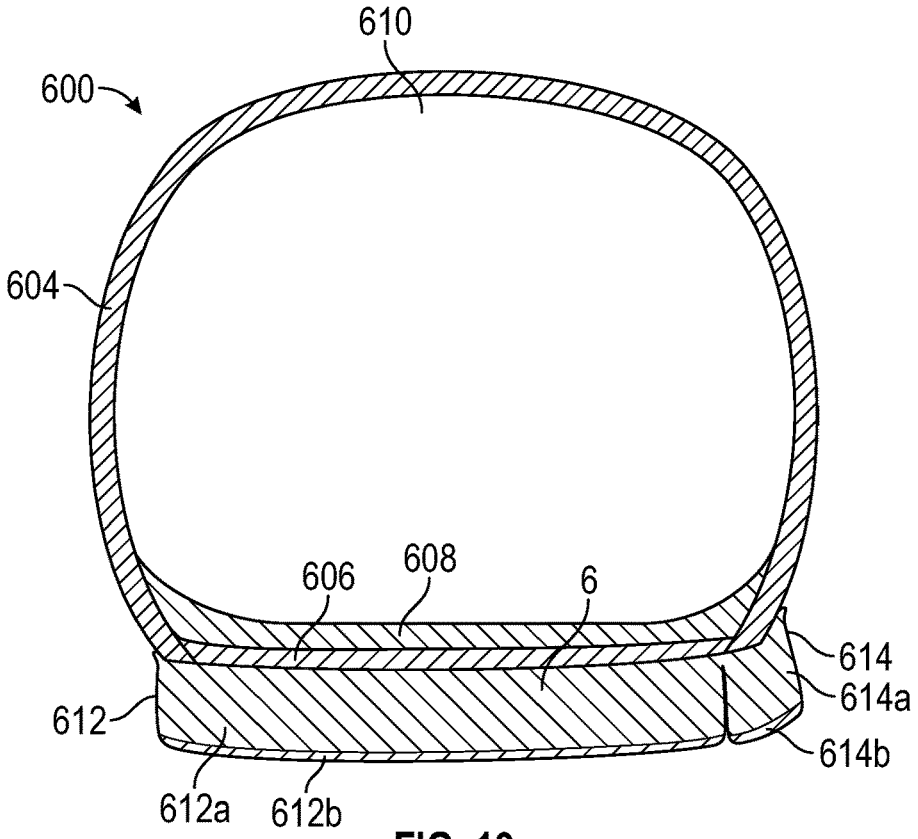
FIG. 19 is a cross-sectional view of the footwear of FIG. 18, depicting the footwear in a deflected or expanded state.

FIGS. 18-19 depict an article of footwear 600 (shown in cross-section). The footwear 600 comprises a sole structure 602, an upper 604, a strobel 606, and a sockliner 608. The upper 604 is coupled to the sole structure 602 via the strobel 606. The footwear 600 comprises a foot-receiving cavity 610 defined by the interior portion of the upper 604 and the sockliner 608. The sole structure 602 includes an extension member that can pivot between a disengaged state (e.g., FIG. 18) and an engaged state (e.g., FIG. 19). The extension member can move from the disengaged state to the engaged state, for example, as a wearer's foot exerts forces on the side of the upper 604 and/or the extension member. In the engaged state, the extension member is disposed under the wearer's foot, thereby extending the sole structure 602. In this manner, the footwear 600 can accommodate feet of various widths. Additional details are provided below.

The sole structure 602 comprises a main body 612 and an extension member 614 protruding from a side of the main body 612. As mentioned above, the extension member 614 can pivot relative to the main body 612 between a disengaged state and an engaged state. In the disengaged state (e.g., FIG. 18), the extension member 614 protrudes in an angled manner relative to the main body 612, and there is a gap 616 between the main body 612 and the extension member 614. As such, the extension member 614 is suspended at least slightly above the inferior-most surface of the main body 612. As the extension member 614 moves from the disengaged state to the engaged state, the extension member 614 pivots inwardly and downwardly toward the main body 612. In the engaged state (e.g., FIG. 19), the extension member 614 contacts the main body 612 and closes the gap 616 therebetween (at least substantially). In the engaged state, the main body 612 and the extension member 614 appear and/or function as a continuous structure (at least substantially). In this manner, the main body 612 and the extension member 614 can collectively and/or individually support a wearer's foot.

In some embodiments, the main body 612 of the sole structure 602 can comprise a midsole portion 612*a* and an outsole portion 612*b*. In some embodiments, the extension member 614 of the sole structure 602 can comprise a midsole portion 614*a* and an outsole portion 614*b*. The midsole portions of the main body 612 and/or the extension member 614 can be configured to provide cushioning under the wearer's foot. The outsole portions of the main body 612 and/or the extension member 614 can be configured for protecting the midsole portions, providing additional support to the wearer's foot, and/or engaging a ground surface.

The sole structure 602 of the footwear 600 includes one extension member (i.e., the extension member 614). In other embodiments, a sole structure can comprise a plurality of extension members. For example, the sole structure can comprise a first extension member extending from a lateral side of the sole structure and a second extension member extending from a medial side of the sole structure. As another example, the sole structure can comprise a first extension member extending from a first side (e.g., a lateral or medial side) of the sole structure, and the sole structure can further comprise a second extension member extending from the first extension member.

Figure 20:
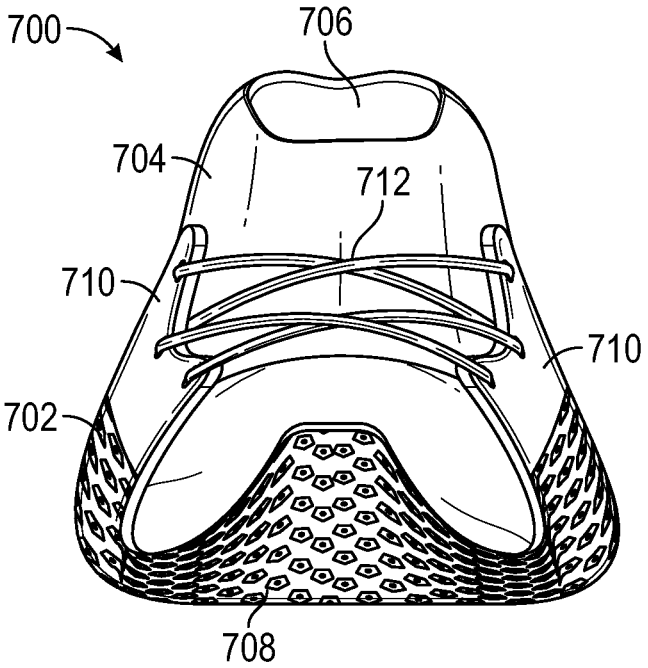
FIG. 20 is a front perspective view of another exemplary article of footwear, depicting the footwear in a compressed state.

FIGS. 20-25 depict an article of footwear 700. Referring to FIG. 20, the footwear 700 comprises two main components: a sole structure 702 and an upper 704. The upper 704 is coupled to the sole structure 702 so as to form a foot-receiving cavity 706 therebetween. One or more dimensions of the footwear 700 can be expanded as the sole structure 702 and the upper 704 expand. More specifically, the sole structure 702 comprises a flexible portion that is movable between one or more compressed states (e.g., FIGS. 20, 22, and 24) and one or more expanded states (e.g., FIGS. 21, 23, and 25). This allows a wearer to adjust the dimensions of the footwear 700 such that the footwear 700 comfortably fits their foot.

Figure 21:
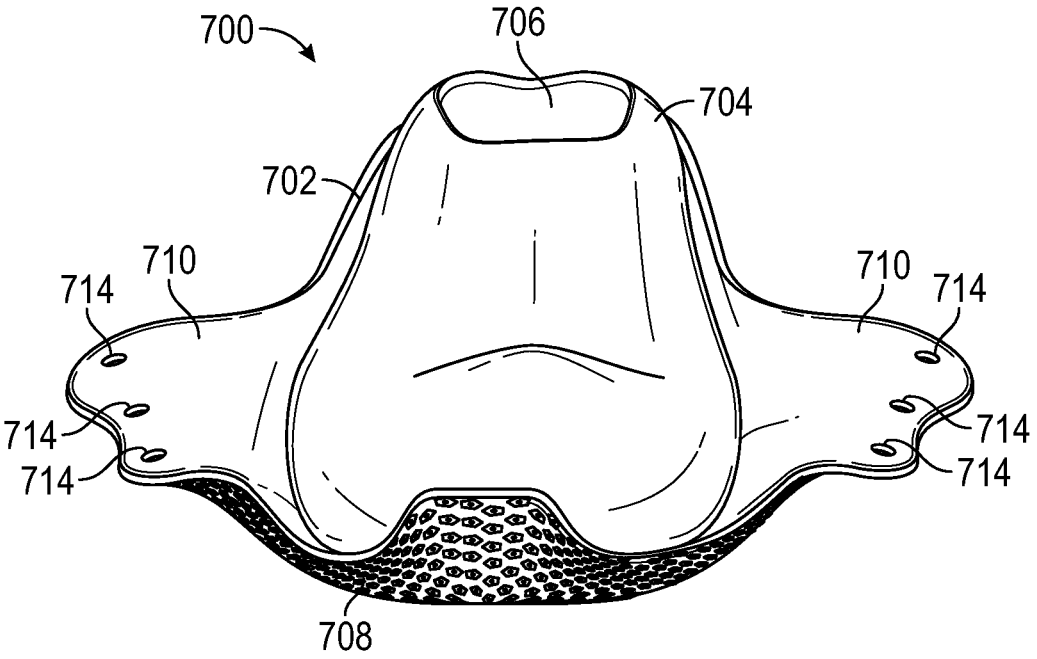
FIG. 21 is a front perspective view of the footwear of FIG. 20, depicting a sole structure of the footwear in a first expanded state.
Figure 24:
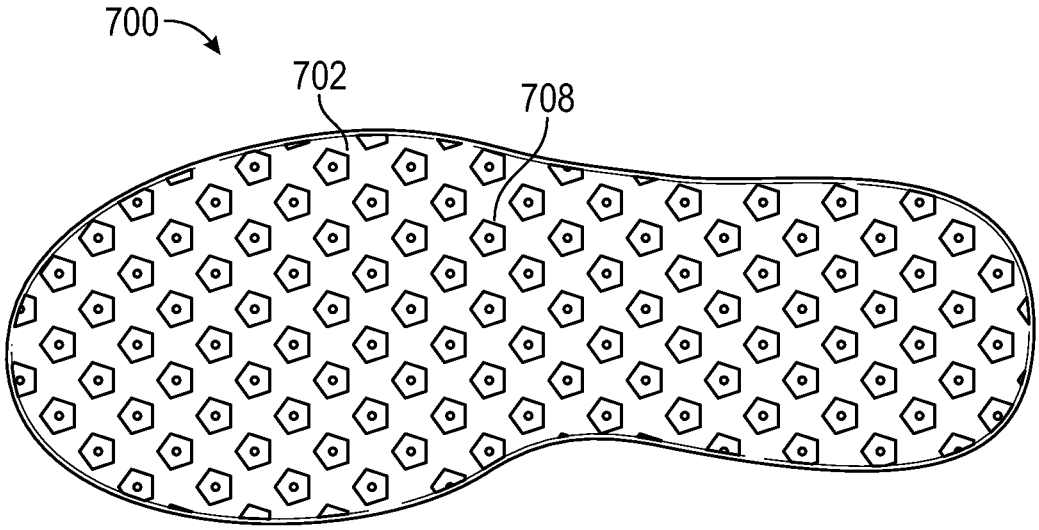
FIG. 24 is a bottom plan view of the footwear of FIG. 20, depicting the footwear in the compressed state.
Figure 25:
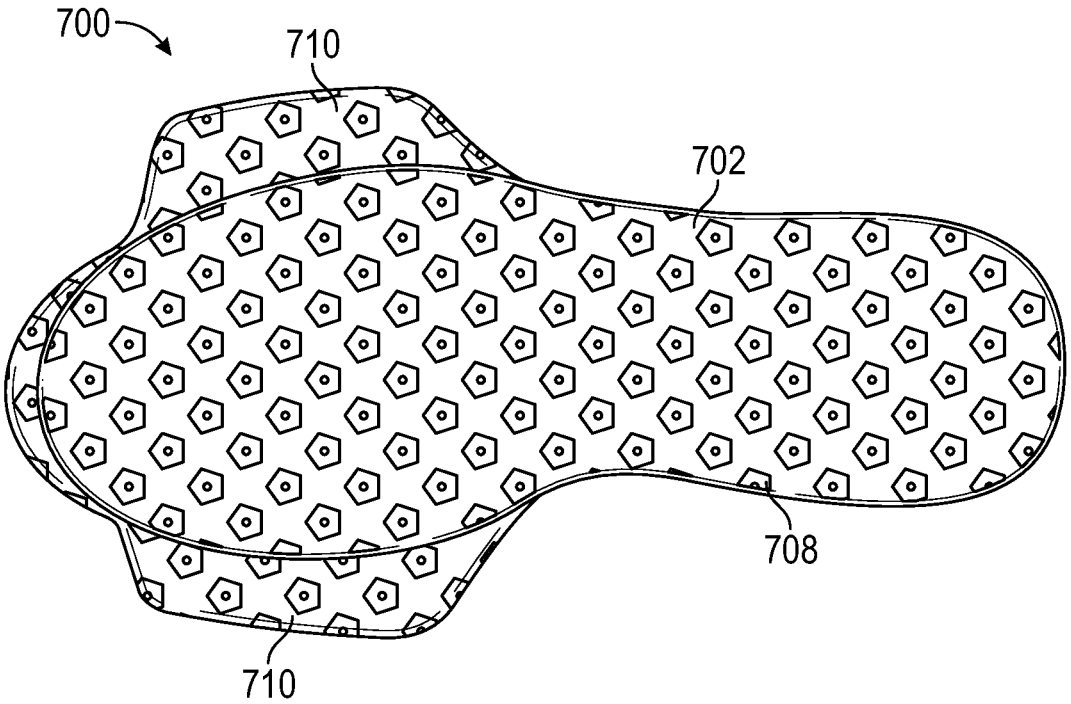
FIG. 25 is a bottom plan view of the footwear of FIG. 20, depicting the footwear in the second expanded state.

Referring to FIGS. 24-25, the sole structure 702 of the footwear 700 comprises a main body 708 and one or more extension members 710 (e.g., two extension members 710 in the illustrated embodiment) protruding from the main body 708. The main body 708 can be configured for supporting the wearer's foot and/or for contacting a ground surface. As depicted in FIGS. 20-21, the extension members 710 can wrap up and/or around the upper 704 when the sole structure 702 is in the compressed configuration. In the expanded configuration, the extension members 710 can unwrap from the upper 704 and at least some portions of the extension members 710 can be flush with an inferior-most surface of the main body 708. As such, the extension members 710 can contact a ground surface and provide additional support to a wearer's foot. This increases one or more dimensions (e.g., width and/or length dimensions) of the footwear 700.

At least one portion of the extension members 710 can be configured for contacting the ground surface. This can be accomplished, for example, by forming the extension members 710 of a material suitable for an outsole. In other embodiments, the extension members 710 can be formed of various other materials (e.g., fabric) and an outsole material can be coupled (e.g., via adhesive, fasteners, stitching, etc.) to the ground-contacting portions of the extension members 710, as depicted in FIG. 25.

The footwear 700 can comprise one or more securing elements (e.g., laces 712, straps, cables, cords, bands, etc.) configured for securing the extension members 710 in a desired configuration. The laces 712 can extend through eyelets 714 (and/or other types of opening) of the extension members 710. Tightening the laces 712 pulls the extension members 710 upward toward the compressed configuration. Loosening the laces 712 allows the extension members 710 to move toward the expanded configuration. For purposes of illustration, FIG. 21 shows the footwear 700 without the laces 712 and in an unfolded/expanded state.

In some embodiments, the laces 712 can also be used to adjust the upper 704. In other embodiments, the footwear 700 can comprise another closure system for the upper 704, such as laces, straps, bands, cords, etc. In some such embodiments, the laces 712 can be coupled (e.g., interlaced) with the other closure system so that the laces 712 and the closure system can be adjusted simultaneously. In other embodiments, the laces 712 and the other closure system can be adjusted separately.

Figure 22:
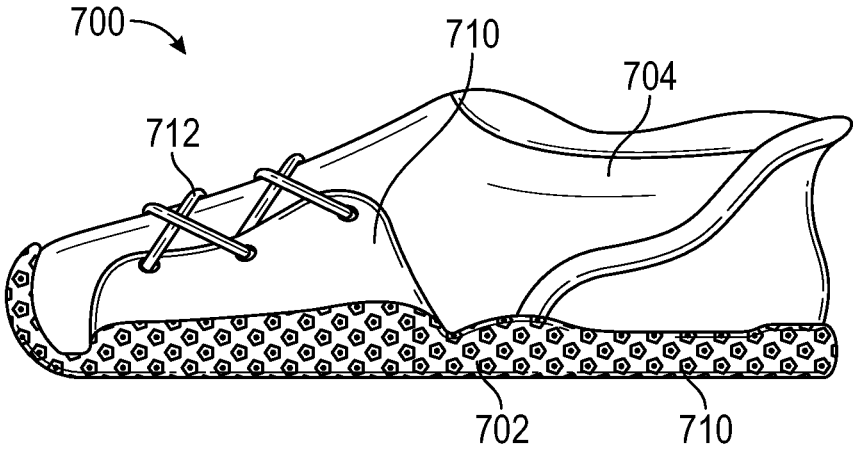
FIG. 22 is side elevation view of the footwear of FIG. 20, depicting the footwear in the compressed state.
Figure 23:
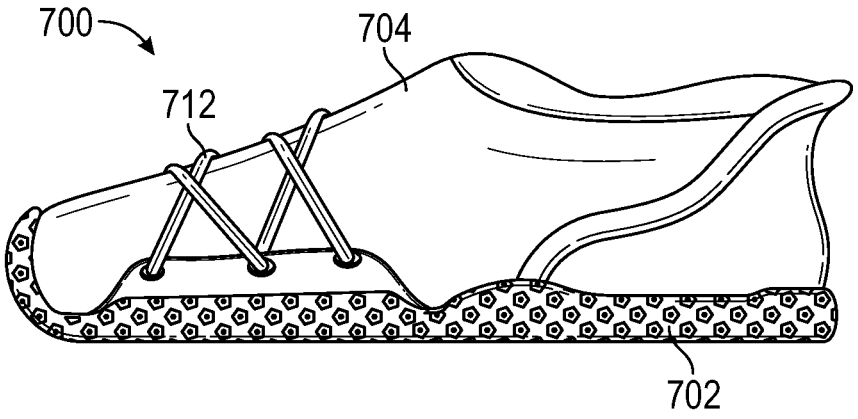
FIG. 23 is side elevation view of the footwear of FIG. 20, depicting the footwear in a second expanded state.

The upper 704 can be formed of a sufficiently stretchable material such that it can conform to the dimensions of the wearer's foot. In this manner, the upper 704 together with the sole structure 702 allow the footwear 700 to be adapted to various dimensions of a wearer's foot. For example, a user with a relatively narrow foot can use the footwear 700 by inserting their foot into the foot-receiving cavity 706. The wearer can then tighten the extension members 710 of the sole structure 702 via the laces 712 so that the extension members 710 are wrapped around the upper 704 (e.g., as depicted in FIGS. 22 and 24). If the wearer's foot is or becomes relatively wider, the wearer can loosen the laces 712, which allows the extension members 710 to move away (e.g., unfold) from the upper 704 (e.g., as depicted in FIGS. 23 and 25). With the extension members 710 unfolded, the upper 704 can stretch outwardly in one or more dimensions (e.g., width and/or length dimensions) to accommodate the wearer's relatively wider/longer foot. One or more portions of the extension members 710 can contact the ground surface and provide support to the wearer's foot. As such, the extension members 710 expand the sole structure 702.

In some embodiments, the toe portion of the sole structure 702 also expands and compresses, either together with the extension members 710 or separately. In some such embodiments, the toe portion can comprise one or more eyelets configured for receiving a securing element (e.g., the laces 712). These configurations, together with the stretchable upper 704, can allow for even greater expansion of the footwear 700 in the length dimension.

Additional Examples of the Disclosed Technology

Additional examples of the disclosed technology are enumerated below.

1. An article of footwear comprising:

an upper; and a sole structure coupled to the upper and forming a foot-receiving cavity therebetween, wherein the sole structure comprises one or more tapered sidewalls, and wherein the one or more tapered sidewalls partially define the foot-receiving cavity.

2. The article of footwear of example 1, wherein the one or more tapered sidewalls comprise a first width at a first location and a second width at a second location, wherein the first width is less than the second width, and wherein the first location is inferior to the second location.

3. The article of footwear of either example 1 or example 2, further comprising an insert member disposed in the foot-receiving cavity and configured to contact the one or more tapered sidewalls.

4. The article of footwear of either example 1 or example 2, further comprising a plurality of insert members disposed in the foot-receiving cavity and configured to contact the one or more tapered sidewalls, wherein the plurality of insert members are stacked on one another.

5. The article of footwear of example 4, wherein the plurality of insert members comprise mating features configured for coupling the plurality of insert members together.

6. The article of footwear of any one of examples 1-5, wherein the sole structure further comprises a base portion, and wherein the one or more tapered sidewalls extend from the base portion.

7. The article of footwear of any one of examples 1-6, wherein the sole structure includes a midsole and an outsole, wherein the midsole includes the one or more tapered sidewalls.

8. An article of footwear comprising:

an upper; and a sole structure coupled to the upper and forming a foot-receiving cavity therebetween, wherein the sole structure comprises one or more flexible sidewalls, wherein the one or more flexible sidewalls partially define the foot-receiving cavity, wherein the one or more flexible sidewalls move between an undeflected state to a deflected state to accommodate feet of various dimensions, and wherein the foot-receiving cavity is wider when the one or more flexible sidewalls are in the deflected state than when the one or more flexible sidewalls are in the undeflected state.

9. The article of footwear of example 8, wherein the sole structure further comprises a base portion, and wherein the one or more flexible sidewalls extend from the base portion.

10. The article of footwear of either example 8 or example 9, wherein the sole structure includes a midsole and an outsole, wherein the midsole includes the one or more flexible sidewalls.

11. The article of footwear of any one of examples 8-10, wherein the flexible sidewalls are configured to remain in the deflected state when a wearer is in a stationary, standing position.

12. The article of footwear of any one of examples 8-10, wherein the flexible sidewalls are configured to remain in the undeflected state when a wearer is in a stationary, standing position.

13. An article of footwear comprising:

an upper;

a sole structure coupled to the upper; and one or more removable insert members, wherein the upper, the sole structure, and the one or more removable insert members at least partially define a foot-receiving cavity therebetween, and wherein the one or more removable insert members are configured for altering one or more dimension of the foot-receiving cavity.

14. The article of footwear of example 13, wherein the one or more removable insert members are disposed adjacent to a side portion of the sole structure.

15. The article of footwear of example 13, wherein the one or more removable insert members is a plurality of removable insert members.

16. The article of footwear example 13, wherein the one or more removable insert members includes a first removable insert member and a second removable insert member, wherein the first removable insert member is disposed adjacent to a medial side portion of the sole structure, and wherein the second removable insert member is disposed adjacent to a lateral side portion of the sole structure.

17. The article of footwear of example 13, wherein the one or more removable insert members is a single removable insert member that extends around an entire periphery of the foot-receiving cavity.

18. The article of footwear of any one of examples 13-17, wherein the one or more removable insert members are configured for altering a width dimension of the foot-receiving cavity.

19. The article of footwear of any one of examples 13-17, wherein the one or more removable insert members are configured for altering a length dimension of the foot-receiving cavity.

20. The article of footwear of any one of examples 13-17, wherein the one or more removable insert members are configured for altering a width dimension and a length dimension of the foot-receiving cavity.

21. An assembly comprising:

the article of footwear of any one of examples 13-20; and one or more additional removable insert members.

22. An article of footwear comprising:

an upper; and a sole structure coupled to the upper and forming a foot-receiving cavity therebetween, wherein the sole structure comprises a midsole and an outsole, wherein the outsole comprises a base portion and one or more flexible side supports, wherein the base portion of the outsole is coupled to an inferior surface of the midsole, wherein the one or more flexible side supports of the outsole extend from the base portion and are coupled to the upper, and wherein the one or more flexible side supports are movable relative to the midsole between a compressed configuration and an expanded configuration.

23. The article of footwear of example 22, wherein the sole structure comprises one or more gaps between the one or more flexible side supports and the midsole when the one or more flexible side supports are in the expanded configuration.

24. The article of footwear of example 23, wherein the upper extends across the one or more gaps.

25. The article of footwear of any one of examples 22-24, wherein the one or more flexible side supports contact the midsole when the one or more flexible side supports are in the compressed configuration.

26. The article of footwear of any one of examples 22-25, wherein the foot-receiving cavity is wider when the one or more flexible side supports are in the expanded configuration than when the one or more flexible side supports are in the compressed configuration.

27. The article of footwear of any one of examples 22-26, wherein the one or more flexible side supports extend from a medial side or a lateral side of the base portion of the outsole.

28. The article of footwear of any one of examples 22-26, wherein the one or more flexible side supports extend from a medial side and a lateral side of the base portion of the outsole.

29. The article of footwear of any one of examples 22-28, wherein the one or more flexible side supports are configured to remain in the expanded configuration when a wearer is in a stationary, standing position.

30. The article of footwear of any one of examples 22-28, wherein the one or more flexible side supports are configured to remain in the compressed configuration when a wearer is in a stationary, standing position.

31. An article of footwear comprising:

an upper; and a sole structure coupled to the upper and forming a foot-receiving cavity therebetween, wherein the sole structure comprises one or more flexible extension members extending therefrom, wherein the one or more flexible extension members are pivotable from a disengaged state to an engaged state, wherein the foot-receiving cavity is wider when the one or more flexible extension members are in the engaged state than when the one or more flexible extension members are in the disengaged state.

32. The article of footwear of example 31, wherein the sole structure further comprises a main body, and wherein the one or more flexible extension members extend from and are pivotably coupled to the main body.

33. The article of footwear of example 32, wherein the sole structure comprises one or more gaps between the main body and the one or more flexible extension members when the one or more flexible extension members are in the disengaged state.

34. The article of footwear of example 33, wherein the one or more gaps are closed when the one or more flexible extension members are in the engaged state.

35. The article of footwear of any one of examples 32-34, wherein side surfaces of the one or more flexible extension members contact the main body when the one or more flexible extension members are in the engaged state.

36. The article of footwear of any one of examples 31-35, wherein when the one or more flexible extension members are in the disengaged state, the one or more flexible extension members are configured so as to be spaced apart from a ground surface.

37. The article of footwear of any one of examples 31-35, wherein when the one or more flexible extension members are in the engaged state, the one or more flexible extension members are configured to contact a ground surface.

38. The article of footwear of any one of examples 31-37, wherein the one or more flexible extension members comprise midsole portions and outsole portions.

39. The article of footwear of any one of examples 31-38, wherein the one or more flexible extension members is a single flexible extension member extending from a lateral side or a medial side of the sole structure.

40. The article of footwear of any one of examples 31-38, wherein the one or more flexible extension members includes a first flexible extension member and a second flexible extension member, wherein the first flexible extension member extends from a lateral side of the sole structure, and wherein the second flexible extension member extends from a medial side of the sole structure.

41. The article of footwear of any one of examples 31-40, wherein the one or more flexible extension members are configured to remain in the disengaged state when a wearer is in a stationary, standing position.

42. The article of footwear of any one of examples 31-40, wherein the one or more flexible extension members are configured to remain in the engaged state when a wearer is in a stationary, standing position.

43. An article of footwear comprising:

an upper; and a sole structure coupled to the upper and forming a foot-receiving cavity therebetween, wherein the sole structure comprises one or more flexible extension members extending therefrom, wherein the one or more flexible extension members are foldable between a compressed state and an expanded state, wherein in the compressed state, the one or more flexible extension members extend at least partially over the upper, and wherein in the expanded state, the one or more flexible extension members comprise one or more portions configured for contacting a ground surface.

44. The article of footwear of example 43, further comprising one or more securing elements adjustably coupled to the one or more flexible extension members and configured for retaining the one or more flexible extension members in the compressed state or the expanded state.

45. The article of footwear of example 44, wherein the one or more securing elements comprise one or more of laces, straps, bands, and cords.

46. The article of footwear of either example 44 or example 45, wherein the one or more flexible extension members comprises one or more openings configured for receiving the one or more securing elements.

47. The article of footwear of any one of examples 43-46, wherein the one or more flexible extension members include a medial extension member and a lateral extension member, wherein the medial extension member is disposed on a medial side of the upper, and wherein the lateral extension member is disposed on a lateral side of the upper.

48. The article of footwear of example 47, wherein the medial extension member is movable relative to the lateral extension member.

49. The article of footwear of any one of examples 43-48, wherein the sole structure includes an outsole, and wherein the one or more flexible extension members and the outsole are formed from the same material.

50. An article of footwear comprising:

an upper; and a sole structure coupled to the upper and comprising a main body and a plurality of extension members, wherein the main body comprises an outsole configured for supporting a wearer's foot and for contacting a ground surface, wherein the plurality of extension members is coupled to and extends from the main body and are foldable between a compressed state and an expanded state, wherein in the compressed state, the plurality of extension members extend at least partially over the upper, and wherein in the expanded state, the plurality of extension members comprise one or more portions configured for contacting a ground surface.

51. The article of footwear of example 50, further comprising one or more securing elements adjustably coupled to the plurality of extension members and configured for retaining the plurality of extension members in the compressed state or the expanded state.

52. The article of footwear of example 51, wherein the one or more securing elements comprise one or more of laces, straps, bands, and cords.

53. The article of footwear of either example 51 or example 52, wherein the plurality of extension members comprises one or more openings configured for receiving the one or more securing elements.

54. The article of footwear of any one of examples 50-53, wherein the plurality of extension members includes a medial extension member, a lateral extension member, and a toe extension member, wherein the medial extension member is disposed adjacent a medial section of the upper, wherein the lateral extension member is disposed adjacent a lateral section of the upper, and wherein the toe extension member is disposed adjacent a toe section of the upper.

55. The article of footwear of example 54, wherein moving the medial extension member and the lateral extension member from the compressed state to the expanded state increases a width of the article of footwear, and wherein moving the toe extension member from the compressed state to the expanded state increases a length of the article of footwear.

56. The article of footwear of either example 54 or example 55, wherein the outsole extends from the main body to the medial extension member, the lateral extension member, and the toe extension member.

57. The article of footwear of any one of examples 54-56, wherein the medial extension member, the lateral extension member, and the toe extension member comprise a fabric, and wherein the outsole is coupled to the fabric.

58. An article of footwear comprising:

an upper formed from a stretchable fabric; and a sole structure coupled to the upper and comprising a main body and a plurality of flexible extension members, wherein the main body comprises an outsole configured for supporting a wearer's foot and for contacting a ground surface, wherein the plurality of flexible extension members is coupled to and extend from the main body and are foldable between a folded state and an unfolded state, wherein in the folded state, a ground contacting surface of the sole structure comprises a first size, and wherein in the unfolded state, the ground contacting surface of the sole structure comprises a second size, which is larger than the first size.

59. The article of footwear of example 58, further comprising one or more laces adjustably coupled to the plurality of flexible extension members, wherein tightening the one or more laces moves the plurality of flexible extension members from the unfolded state to the folded state, and wherein loosening the one or more laces moves the plurality of flexible extension members from the folded state to the unfolded state.

60. The article of footwear of example 59, wherein the plurality of flexible extension members comprises one or more openings configured for receiving the one or more laces.

61. The article of footwear of example 60, wherein the upper comprises a plurality of eyelets configured for receiving the one or more laces.

62. The article of footwear of any one of examples 59-61, wherein the one or more laces includes a first lace member and a second lace member, wherein the first lace member is adjustably coupled to the plurality of flexible extension members, and wherein the second lace member extends through the plurality of eyelets of the upper and is interlaced with the first lace member.

63. An article of footwear comprising:

an upper; and a sole structure comprising a midsole and an outsole, wherein the midsole is coupled to the upper and comprises one or more flexible sidewalls, wherein the one or more flexible sidewalls partially define a foot-receiving cavity, wherein the one or more flexible sidewalls move between an undeflected state to a deflected state to accommodate feet of various dimensions, wherein the foot-receiving cavity is wider when the one or more flexible sidewalls are in the deflected state than when the one or more flexible sidewalls are in the undeflected state, and wherein the outsole is coupled to the midsole and is configured for contacting a ground surface.

64. The article of footwear of example 63, wherein the midsole further comprises a base portion, and wherein the one or more flexible sidewalls extend from the base portion.

65. The article of footwear of any one of examples 63-64, wherein the one or more flexible sidewalls are configured to remain in the deflected state when a wearer is in a stationary, standing position.

66. The article of footwear of any one of examples 63-64, wherein the one or more flexible sidewalls are configured to remain in the undeflected state when a wearer is in a stationary, standing position.

67. The article of footwear of any one of examples 63-66, wherein the one or more flexible sidewalls comprise a tapered shape that is wider at an inferior location than a superior location.

68. The article of footwear of any one of examples 63-66, wherein the one or more flexible sidewalls are vertical or at least substantially vertical when the one or more flexible sidewalls are in the undeflected state.

69. The article of footwear of any one of examples 63-68, wherein the upper is formed of a stretchable material and are coupled to a superior portion of the one or more flexible sidewalls.

70. The article of footwear of any one of examples 63-69, wherein the one or more flexible sidewalls is a single flexible sidewall configured to circumscribe a wearer's foot.

71. The article of footwear of any one of examples 63-69, wherein the one or more flexible sidewalls includes a medial flexible sidewall and a lateral flexible sidewall, wherein the medial flexible sidewall is configured to contact a medial side of a wearer's foot, and wherein the lateral flexible sidewall is configured to contact a lateral side of the wearer's foot.

Any feature(s) of any example(s) disclosed herein can be combined with or isolated from any feature(s) of any example(s) disclosed herein, unless otherwise stated. For example, any one or more of the features of the article of footwear 200 can be combined with any one or more features of the article of footwear 300, or vice versa. As another example, any one or more of the features of the article of footwear 400 can be combined with any one or more features of the article of footwear 200, or vice versa. As yet another example, any one or more of the features of the article of footwear 700 can be combined with any one or more features of the article of footwear 300, or vice versa.

In view of the many possible embodiments to which the principles of the disclosure may be applied, it should be recognized that the illustrated embodiments are only examples and should not be taken as limiting the scope of the disclosure.

The invention claimed is:

1. An article of footwear comprising:

an upper;

a sole structure coupled to the upper and forming a foot-receiving cavity therebetween, wherein the sole structure comprises:

a main body positioned underneath the upper for supporting a wearer's foot; and a plurality of flexible extension members extending from sides of the main body, and one or more securing elements separate from the upper, wherein the plurality of flexible extension members includes a medial extension member, a lateral extension member, and a toe extension member, wherein the medial extension member is disposed adjacent a medial section of the upper, wherein the lateral extension member is disposed adjacent a lateral section of the upper, wherein the toe extension member is disposed adjacent a toe section of the upper, wherein the plurality of flexible extension members are foldable between a compressed state and an expanded state, wherein in the expanded state, the plurality of flexible extension members comprise one or more lower portions that are flush with an inferior-most surface of the main body to form a ground contacting surface, wherein in the compressed state, the medial extension member and the lateral extension member extend at least partially over the upper, and wherein the one or more securing elements are adjustably coupled to the plurality of flexible extension members and configured to pull the medial extension member upward toward the compressed state.

2. The article of footwear of claim 1, wherein the one or more securing elements comprise one or more of laces, straps, bands, and cords.

3. The article of footwear of claim 1, wherein the plurality of extension members comprises one or more openings configured for receiving the one or more securing elements.

4. The article of footwear of claim 1, wherein the medial extension member is movable relative to the lateral extension member.

5. The article of footwear of claim 1, wherein the sole structure includes an outsole, and wherein the plurality of flexible extension members and the outsole comprise the same material as one another.

6. The article of footwear of claim 1, wherein at least one securing element of the one or more securing elements is adjustably coupled to each of the medial extension member and the lateral extension member.

7. The article of footwear of claim 1, wherein the upper extends continuously between a medial side of the sole structure and a lateral side of the sole structure and from a midfoot portion of the footwear to a forefront portion of the footwear.

8. An article of footwear comprising:

an upper;

a sole structure coupled to the upper and comprising:

a main body positioned underneath the upper; and a plurality of extension members extending from sides of the main body, and one or more securing elements separate from the upper and adjustably coupled to the plurality of extension members, wherein the main body comprises an outsole positioned underneath the upper for supporting a wearer's foot and for contacting a ground surface, wherein the plurality of extension members is coupled to and extends from the main body and are foldable between a compressed state and an expanded state, wherein in the expanded state, the plurality of extension members comprises one or more lower portions that are flush with an inferior-most surface of the main body to form a ground contacting surface, wherein in the compressed state, each extension member of the plurality of extension members extends at least partially over the upper and the one or more lower portions of the plurality of extension members are pulled upward around the upper, wherein the plurality of extension members includes a medial extension member, a lateral extension member, and a toe extension member, wherein the medial extension member is disposed adjacent a medial section of the upper, wherein the lateral extension member is disposed adjacent a lateral section of the upper, and wherein the toe extension member is disposed adjacent a toe section of the upper.

9. The article of footwear of claim 8, wherein the one or more securing elements comprise one or more of laces, straps, bands, and cords.

10. The article of footwear of claim 8, wherein the plurality of extension members comprises one or more openings configured for receiving the one or more securing elements.

11. The article of footwear of claim 8, wherein moving the medial extension member and the lateral extension member from the compressed state to the expanded state increases a width of the article of footwear, and wherein moving the toe extension member from the compressed state to the expanded state increases a length of the article of footwear.

12. The article of footwear of claim 11, wherein the outsole extends from the main body to the medial extension member, the lateral extension member, and the toe extension member.

13. The article of footwear of claim 12, wherein the medial extension member, the lateral extension member, and the toe extension member comprise a fabric, and wherein the outsole is coupled to the fabric.

14. The article of footwear of claim 8, wherein at least one securing element of the one or more securing elements is adjustably coupled to each of the medial extension member and the lateral extension member.

15. The article of footwear of claim 8, wherein the upper comprises a contiguous layer that substantially covers a dorsal portion of the wearer's foot and that extends around a heel of the wearer's foot when the article of footwear is worn by the wearer.

16. An article of footwear comprising:

an upper formed from a stretchable fabric;

a sole structure coupled to the upper and comprising:

a main body; and a plurality of flexible extension members extending from sides of the main body, and one or more laces adjustably coupled to the plurality of flexible extension members, wherein the main body comprises an outsole positioned underneath the upper for supporting a wearer's foot and for contacting a ground surface, wherein the plurality of flexible extension members is coupled to and extends from the main body and is foldable between a folded state and an unfolded state, wherein in the folded state, a ground contacting surface of the sole structure comprises a first size, wherein in the unfolded state, the ground contacting surface of the sole structure comprises a second size, which is larger than the first size, wherein the plurality of flexible extension members includes a medial extension member and a lateral extension member, wherein the medial extension member is disposed adjacent a medial section of the upper, wherein the lateral extension member is disposed adjacent a lateral section of the upper, wherein the one or more laces extend directly between the medial extension member and the lateral extension member, and wherein the upper comprises a contiguous layer that substantially covers a dorsal portion of the wearer's foot and that extends around a heel of the wearer's foot when the article of footwear is worn by the wearer.

17. The article of footwear of claim 16, wherein tightening the one or more laces moves the plurality of flexible extension members from the unfolded state to the folded state, and wherein loosening the one or more laces moves the plurality of flexible extension members from the folded state to the unfolded state.

18. The article of footwear of claim 17, wherein the plurality of flexible extension members comprises one or more openings configured for receiving the one or more laces.

* * * * *